US010772434B2

(12) United States Patent
Susie et al.

(10) Patent No.: US 10,772,434 B2
(45) Date of Patent: Sep. 15, 2020

(54) ARM WIDTH ADJUSTMENT

(71) Applicant: HNI Technologies Inc., Muscatine, IA (US)

(72) Inventors: Corey Susie, Muscatine, IA (US); Bradley D. Malli, Bettendorf, IA (US); Trevor J. Roose, Iowa City, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 15/880,843

(22) Filed: Jan. 26, 2018

(65) Prior Publication Data

US 2018/0213940 A1 Aug. 2, 2018

Related U.S. Application Data

(60) Provisional application No. 62/451,376, filed on Jan. 27, 2017.

(51) Int. Cl.

| | |
|---|---|
| ***A47C 7/54*** | (2006.01) |
| ***A47C 1/03*** | (2006.01) |
| *A47C 4/02* | (2006.01) |

(52) U.S. Cl.

CPC ..... *A47C 7/546* (2013.01); *A47C 1/0307* (2018.08); *A47C 4/02* (2013.01)

(58) Field of Classification Search

CPC ..... A47C 7/546; A47C 7/541; A47C 1/0307; A47C 4/02

See application file for complete search history.

(56) References Cited

U.S. PATENT DOCUMENTS

| | | | | |
|---|---|---|---|---|
| 5,419,617 | A * | 5/1995 | Schultz | A47C 7/546 292/19 |
| 5,944,387 | A * | 8/1999 | Stumpf | A47C 1/03 297/411.26 |
| 6,296,313 | B1 * | 10/2001 | Wu | A47C 1/03 297/353 |
| 6,572,195 | B1 * | 6/2003 | Lee | A47C 1/03 297/411.35 |
| 7,243,997 | B1 * | 7/2007 | Tornero | A47C 1/03 297/383 |
| 7,806,481 | B2 * | 10/2010 | Eberlein | A47C 7/402 297/353 |
| 8,104,838 | B2 * | 1/2012 | Tsai | A47C 1/03 297/383 |
| 8,459,746 | B2 * | 6/2013 | Lai | A47C 1/03 297/115 |
| 9,795,220 | B1 * | 10/2017 | Chen | A47C 1/03 |
| 2017/0027329 | A1 * | 2/2017 | Su | A47C 1/03 |

* cited by examiner

*Primary Examiner* — Philip F Gabler
(74) *Attorney, Agent, or Firm* — Faegre Drinker Biddle & Reath LLP

(57) ABSTRACT

Various aspects of the present disclosure are directed toward apparatuses, systems, and methods that include a chair for assembly by a user. The chair for assembly by a user may include a bracket configured to releasably couple an arm rest assembly to a chair seat and facilitate adjusting a width for the arm rest assembly relative to the chair seat.

9 Claims, 23 Drawing Sheets

ARM WIDTH ADJUSTMENT

CROSS REFERENCE TO RELATED APPLICATION

The present application claims benefit to Provisional Patent Application Ser. No. 62/451,376, filed on Jan. 27, 2017, and titled ARM WIDTH ADJUSTMENT, the entire disclosure of which is hereby incorporated by reference herein.

BACKGROUND

Chair designs can impact a seated user's experience. Designs that address a person's comfort are desirable. Although various chair designs have been proposed, improvements remain to be realized.

SUMMARY

Various aspects of the present disclosure are directed toward chairs for assembly by a user. In certain instances, the chairs may include a chair seat having an upper portion and a lower portion, and a seating portion secured to the upper portion of the chair seat. The chairs may also include a back support portion coupled to the chair seat and configured to support a back of the user and an arm rest assembly releasably coupled to the chair seat. Further, the chairs may include a bracket coupled to the lower portion of the chair seat and configured to releasably couple the arm rest assembly to the chair seat and facilitate adjusting a width for the arm rest assembly relative to the chair seat.

Aspects of the present disclosure are also directed toward chairs that include an arm rest assembly releasably coupled to a chair seat. The chairs may also include a bracket configured to releasably couple the arm rest assembly to the chair seat and facilitate adjusting a width for the arm rest assembly relative to the chair seat, and a lever coupled to the bracket and configured to releasably lock the arm rest assembly within the bracket at a desired width for the arm rest assembly relative to the chair seat.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
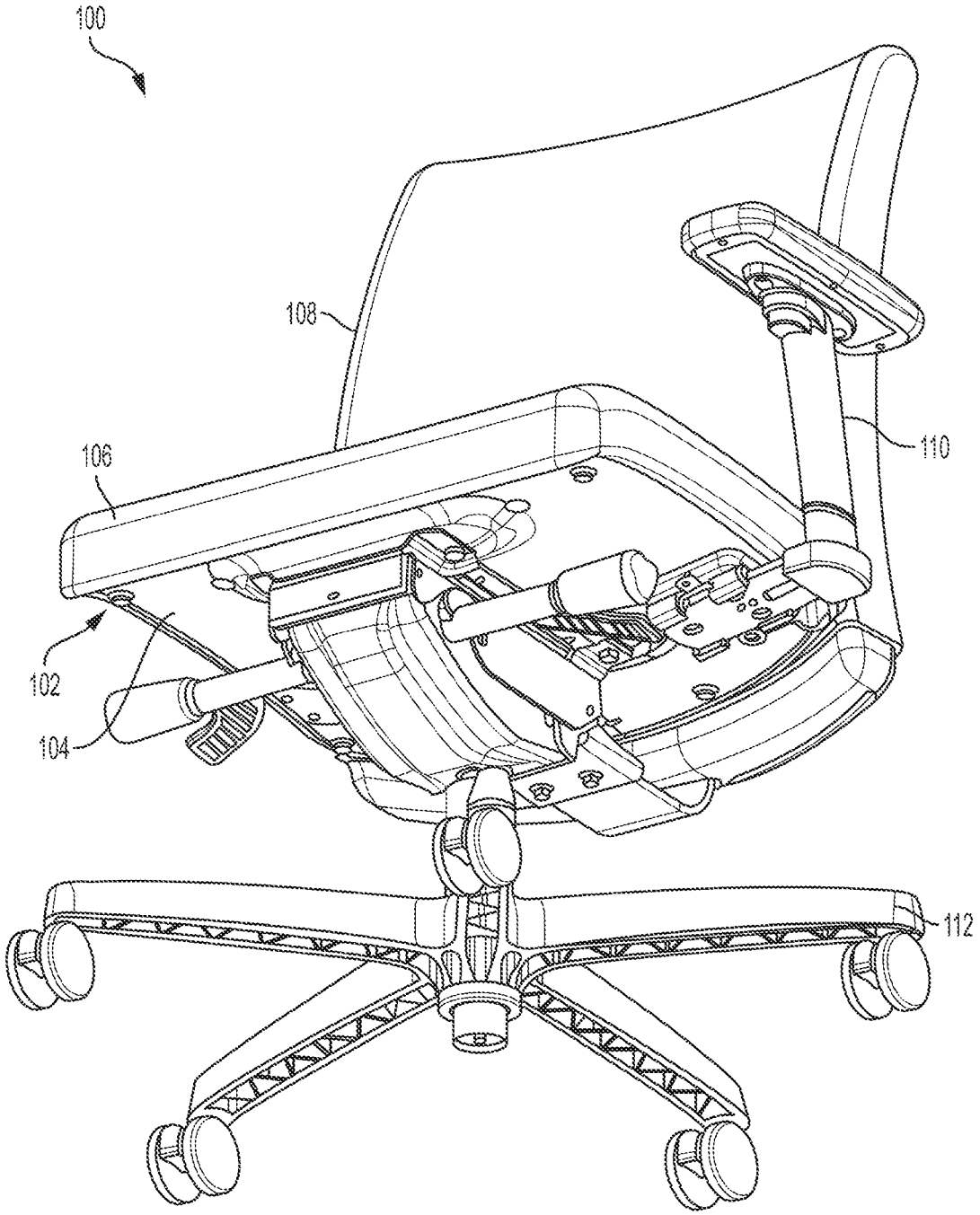
FIG. 1 shows an example chair, consistent with various aspects of the present disclosure.

While the disclosed subject matter is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosed subject matter as characterized by the appended claims.

As the terms are used herein with respect to ranges of measurements (such as those disclosed immediately above), "about" and "approximately" may be used, interchangeably, to refer to a measurement that includes the stated measurement and that also includes any measurements that are reasonably close to the stated measurement, but may differ by a reasonably small amount such as will be understood, and readily ascertained, by individuals having ordinary skill in the relevant arts to be attributable to measurement error, differences in measurement and/or manufacturing equipment calibration, human error in reading and/or setting measurements, adjustments made to optimize performance and/or structural parameters in view of differences in measurements associated with other components, particular implementation scenarios, imprecise adjustment and/or manipulation of objects by a person or machine, and/or the like.

DETAILED DESCRIPTION

FIG. 1 shows an example chair 100, consistent with various aspects of the present disclosure. The chair 100 may include a chair seat 102 having an upper portion (not shown) and a lower portion 104. The chair 100 may also include a seating portion 106 secured to the upper portion of the chair seat 102, and a back support portion 108 coupled to the chair seat 102 and configured to support a back of a user. The chair 100 also may include an arm rest assembly 110 releasably coupled to the chair seat 102. In certain instances, the chair 100 may include an additional arm rest assembly 110 arranged on an opposite side of the chair seat 102 than the arm rest assembly 110 shown in FIG. 1. Further, the chair 100 may also include a base portion 112 coupled to the chair seat 102 that may include a series of legs.

In certain instances, one or more of the chair seat 102, the seating portion 106, the back support portion 108, the arm rest assembly 110, and the base portion 112 may be separately packed together for assembly by a user. The user may receive the portions of the chair 100 after purchasing a package containing the chair 100.

The arm rest assembly 110 may include a height adjustable mechanism such that the arm rest assembly 110 may be raised and lowered, relative to the chair seat 102. In addition, the arm rest assembly 110 may include a width adjustable mechanism such that the arm rest assembly 110 may be moved inwardly and outwardly, relative to the chair seat 102.

Figure 2:
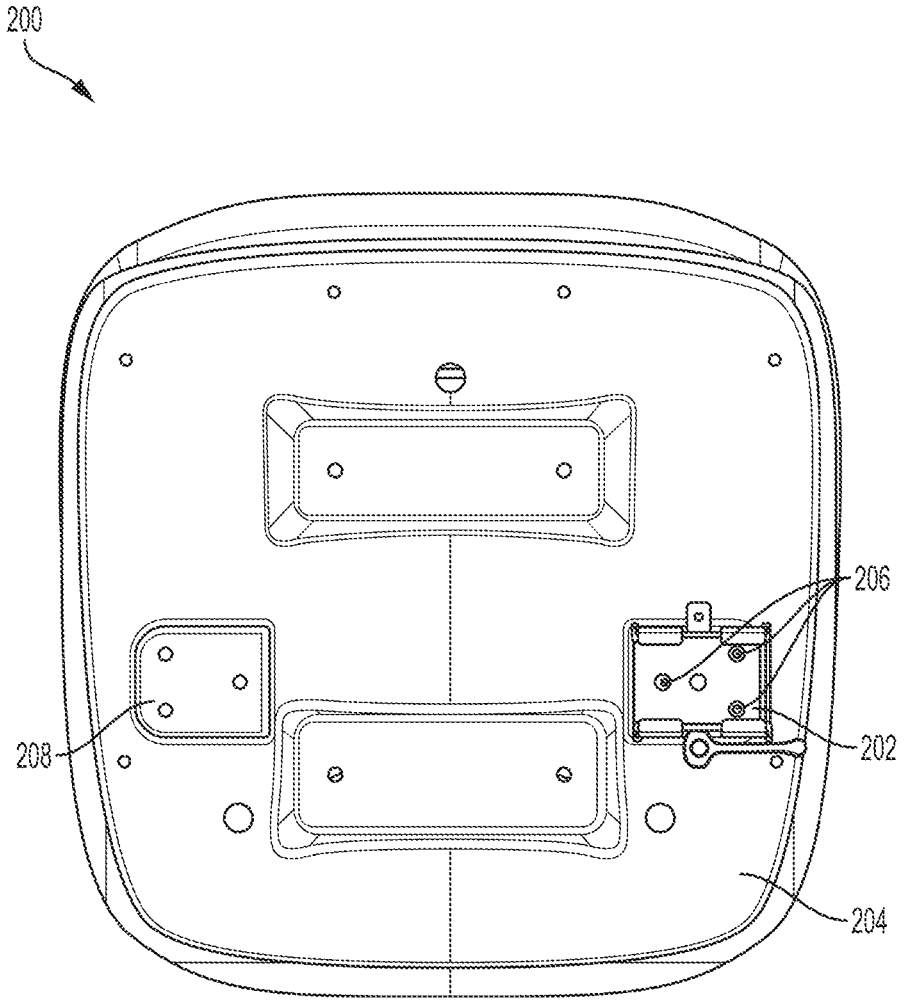
FIG. 2 shows a bottom view of an example chair seat, consistent with various aspects of the present disclosure.

FIG. 2 shows a bottom view of an example chair seat 200, consistent with various aspects of the present disclosure. The chair seat 200 may be a portion of a chair (e.g., as shown in FIG. 1.). The chair seat 200 includes a bracket 202 arranged on a lower portion 204 of the chair seat 200 and near a perimeter thereof. The bracket 202 may be secured to the chair seat 200 by one or more attachment mechanisms 206 such as screws, bolts, rivets, or other similar devices.

The bracket 202 may be configured to releasably couple an arm rest assembly (not shown) to the chair seat 200. The bracket 202 may also be configured to facilitate adjusting a width for the arm rest assembly relative to the chair seat 200. In certain instances, the chair seat 200 may include an additional bracket 202 arranged at an opposite location 208 of the bracket 202 shown in FIG. 2 for releasable coupling of an additional arm rest assembly (not shown) to the chair seat 200.

Figure 3A:
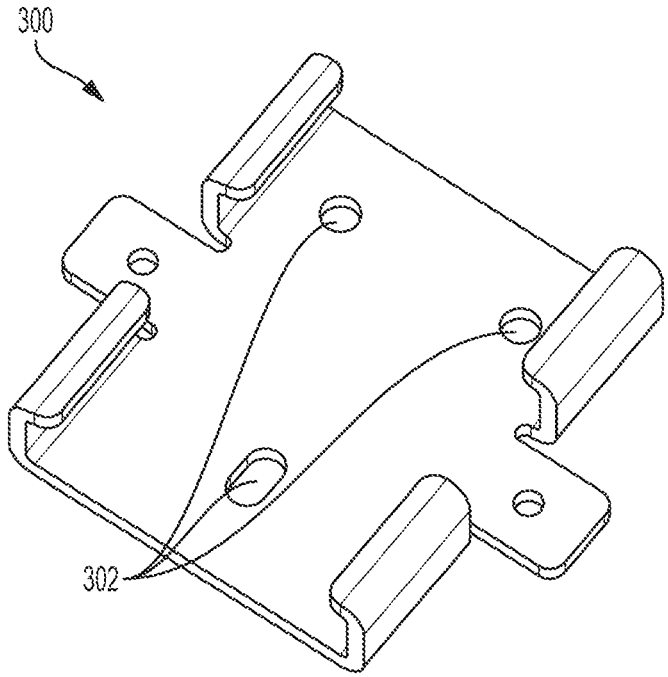
FIG. 3A shows an example bracket, consistent with various aspects of the present disclosure.

FIG. 3A shows an example bracket 300, consistent with various aspects of the present disclosure. As shown in FIG. 3A, the bracket 300 may include one or more holes 302 to facilitate attachment of the bracket 300 to a chair seat (e.g., as shown in FIGS. 1-2). The bracket 300 may be secured to the chair seat (not shown) by one or more attachment mechanisms (such as screws, bolts, rivets, or other similar devices) arranged through the holes 302 and into the chair seat.

The bracket 300 may be configured to releasably couple an arm rest assembly (e.g., shown in FIG. 1) to the chair seat. In certain instances, the bracket 300 may also be configured to facilitate adjusting a width for the arm rest assembly relative to the chair seat.

Figure 3B:
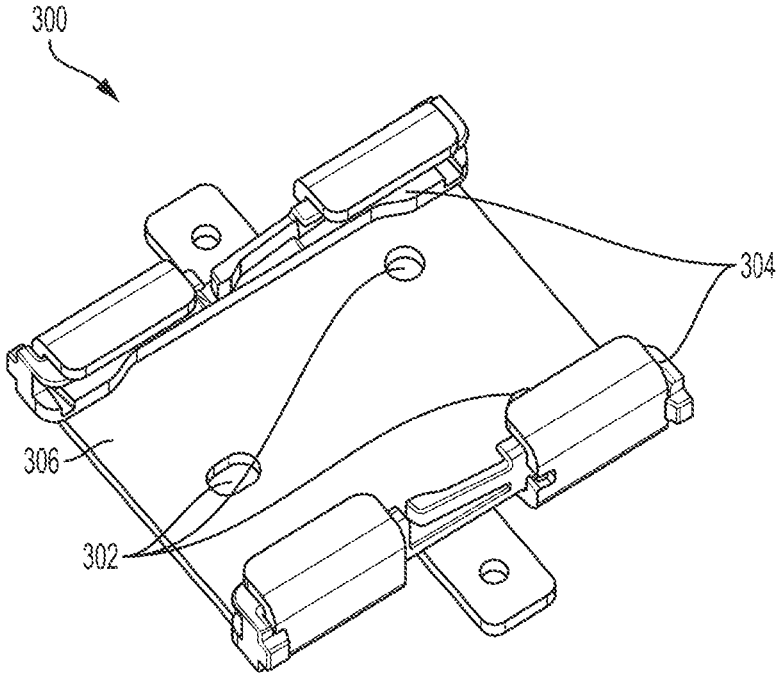
FIG. 3B shows the bracket, shown in FIG. 3A, and glides, consistent with various aspects of the present disclosure.

FIG. 3B shows the bracket 300, shown in FIG. 3A, and glides 304, consistent with various aspects of the present disclosure. In certain instances, the bracket 300 may include the glides 304 to facilitate adjusting the width for the arm rest assembly relative to the chair seat. The glides 304 may be configured as a pathway for a horizontal portion of the arm rest assembly to slide. The pathway provided by the glides 304 is raised relative to a lower surface 306 of the bracket 300. In addition, the glides 304 may provide a level horizontal pathway through which the horizontal portion of the arm rest assembly may slide. In certain instances, the horizontal portion of the arm rest assembly and the bracket 300 may be constructed of the same or similar materials. The glides 304 may enhance the ability of the horizontal portion of the arm rest assembly to slide, as compared to sliding along the bracket 300, and mitigate against the horizontal portion of the arm rest assembly having an uneven arrangement within the bracket 300. The glides 304 may grip and at least partially surround the horizontal portion of the arm rest assembly to facilitate sliding thereof.

The illustrative components shown in FIGS. 3A-B are not intended to suggest any limitation as to the scope of use or functionality of embodiments of the disclosed subject matter. Neither should the illustrative components be interpreted as having any dependency or requirement related to any single component or combination of components illustrated therein. Additionally, any one or more of the components depicted in any of the FIGS. 3A-B may be, in embodiments, integrated with various other components depicted therein (and/or components not illustrated), all of which are considered to be within the ambit of the disclosed subject matter.

Figure 4B:
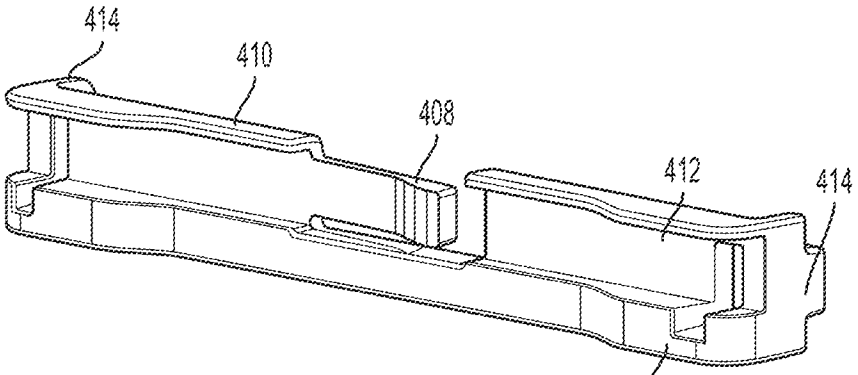
FIG. 4B shows an example glide, consistent with various aspects of the present disclosure.
Figure 4C:
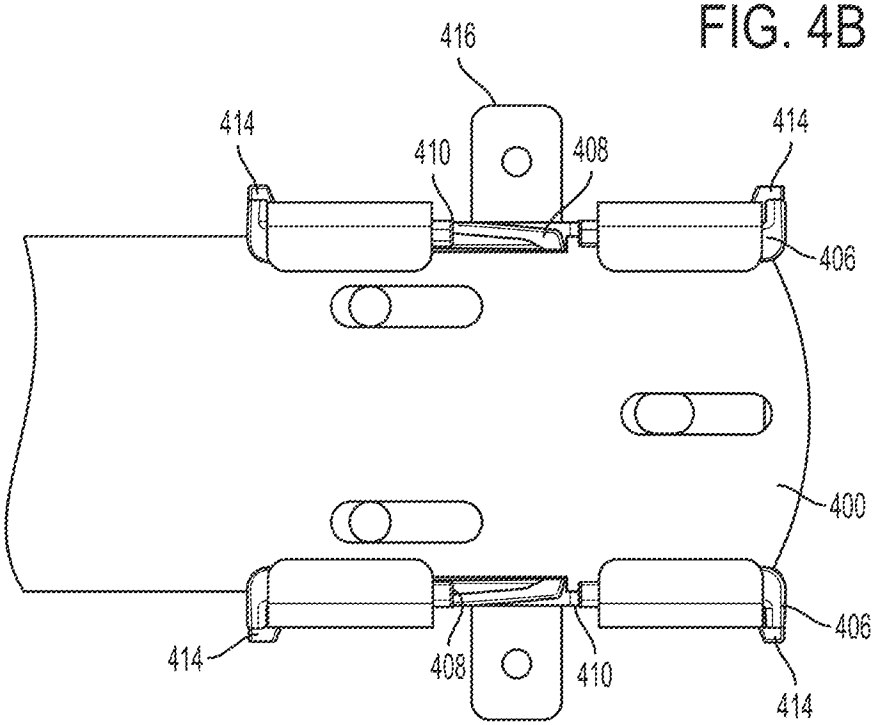
FIG. 4C shows a top view of an example bracket with the portion of arm rest assembly and the glide, shown in FIGS. 4A-B, consistent with various aspects of the present disclosure.
Figure 4A:
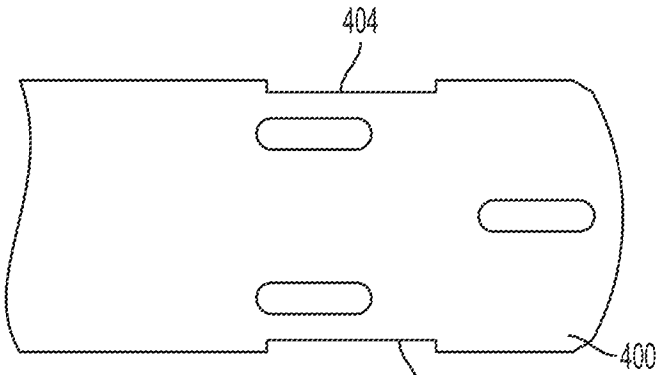
FIG. 4A shows a portion of an example arm rest assembly, consistent with various aspects of the present disclosure.
Figure 4D:
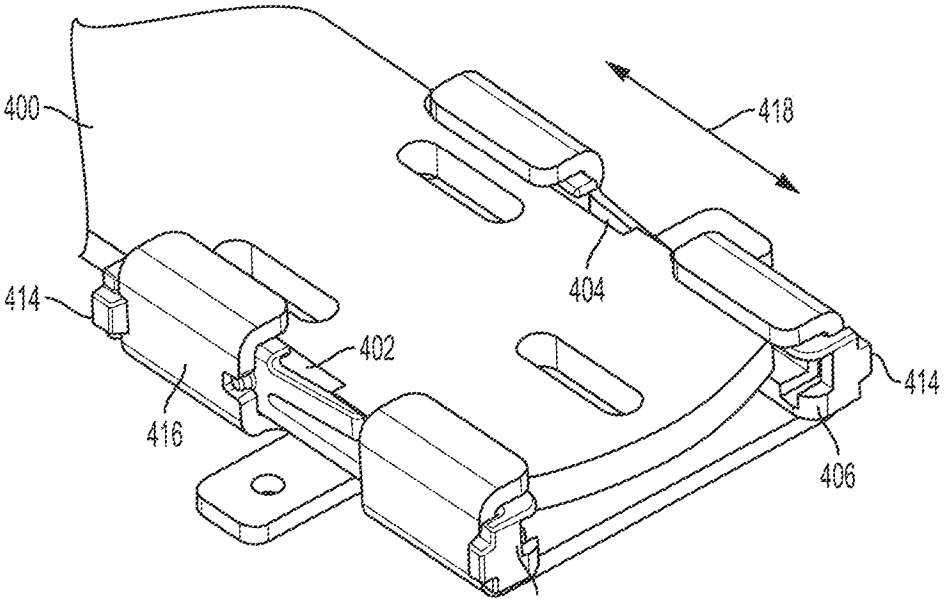
FIG. 4D shows an angled view of the bracket with the portion of arm rest assembly and the glide, shown in FIGS. 4A-C, consistent with various aspects of the present disclosure.
Figure 4E:
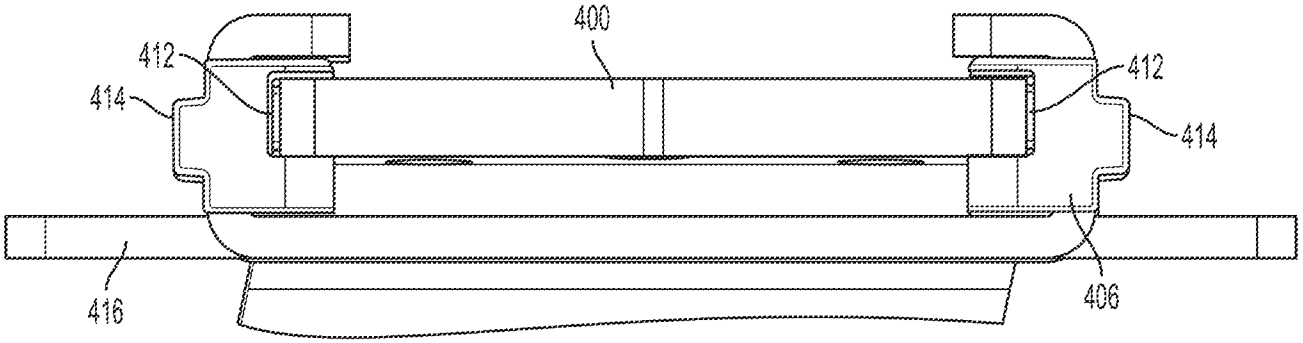
FIG. 4E shows a side view of the bracket with the portion of arm rest assembly and the glide, shown in FIGS. 4A-D, consistent with various aspects of the present disclosure.

FIG. 4A shows a portion 400 of an example arm rest assembly, consistent with various aspects of the present disclosure. The arm rest assembly (e.g., as shown in FIG. 1) may include a vertical portion and a horizontal portion. The horizontal portion of the portion 400 of the arm rest assembly shown in FIG. 4A, extends inwardly toward a chair seat (not shown) with the vertical portion extending upwardly toward a forearm or elbow of a seated user. The portion 400 of the arm rest assembly may be configured to interface with or couple to a bracket (as shown in FIGS. 4C-E) and/or at least one glides 406. In certain instances, the portion 400 of the arm rest assembly may include notches 402, 404 that interface with the glides 406.

FIG. 4B shows the glides 406, consistent with various aspects of the present disclosure. The glides 406 may include a snap-feature 408 that is configured to interface with one of the notches 402, 404 of the portion 400. The snap-feature 408 may be a tab that projects inwardly from an exterior surface 410 of the glides 406. In addition, the glides 406 may include a recessed surface 412 that provides a pathway for the portion 400 of the arm rest assembly shown in FIG. 4A. in certain instances, the glides 406 may include external features 414 that are configured to engage a bracket 416 as shown in FIG. 4C.

FIG. 4C shows a top view of the bracket 416 with the portion 400 of arm rest assembly and the glides 406, shown in FIGS. 4A-B, consistent with various aspects of the present disclosure. The bracket 416 may be coupled to a lower portion of a chair seat (e.g., as shown in FIGS. 1-2). In addition, the bracket 416 may be configured to releasably couple the arm rest assembly to the chair seat and facilitate adjusting a width for the arm rest assembly relative to the chair seat. In certain instances and as shown in FIG. 4C, the bracket 416 may be configured to releasably couple the portion 400 of arm rest assembly to the chair seat and facilitate adjusting a width for the arm rest assembly relative to the chair seat. Further, the portion 400 of arm rest assembly may be configured to slide within the bracket 416 for the user to releasably couple the arm rest assembly to the chair seat, and adjust the width for the arm rest assembly relative to the chair seat.

As noted above with respect to FIG. 1, portions of a chair may be separately packed together for assembly by a user. The user may receive the portions of the chair after purchasing a package containing the chair. In certain instances, the bracket 416 may be separated from the arm rest assembly. Thus, the user may slide the portion 400 of arm rest assembly within the bracket 416 for the user to releasably couple the arm rest assembly to the chair seat. In certain instances, the bracket 416 may be configured to mitigate against removal of the arm rest assembly (e.g., the portion 400 of arm rest assembly) from the bracket 416 subsequent to releasably coupling the arm rest assembly thereto.

The glides 406 may be arranged within the bracket 416. In certain instances, the glides 406 may be snapped into the bracket 416. As shown in FIG. 4C, two of the glides 406 are arranged within the bracket 416. In certain instances, one or more glides 406 are configured to stop the arm rest assembly (e.g., the portion 400 of arm rest assembly) from removal from the bracket subsequent to releasably coupling the arm rest assembly thereto. For example, the notches 402, 404 in the portion 400 of arm rest assembly may snap into the snap-feature 408 of the glides 406. The glides 406 may be configured as a stop for the portion 400 of arm rest assembly such that once the portion 400 of arm rest assembly is pushed passed the snap-feature 408 and the notches 402, 404 are engaged, the portion 400 of arm rest assembly may not be removed from the bracket 416 without user intervention. The notches 402, 404 are configured to unsnap from the snap-feature 408 of the glides 406 in response to intervention of the user (e.g., the user intentionally forces the snap-feature 408 of the glides 406 out of the notches 402, 404).

The portion 400 of arm rest assembly may be configured to slide within the glides 406 to adjust the width for the arm rest assembly relative to the chair seat. The portion 400 of arm rest assembly may be configured to slide within the glides 406 subsequent to the notches 402, 404 being engaged and snapped into the snap-feature 408 of the glides 406. The portion 400 of arm rest assembly rides on the glides 406 within the bracket 416 to adjust the width without allowing the portion 400 of arm rest assembly to accidently be removed from the bracket 416. In certain instances, the amount of movement of the portion 400 of arm rest assembly within the bracket 416 is approximately equal to a length of the notches 402, 404. For example, the snap-feature 408 of the glides 406 may be a stop mechanism such that sidewalls of the notches 402, 404 contact the snap-feature 408 of the glides 406, which stops the portion 400 of arm rest assembly from sliding past the snap-feature 408 of the glides 406, and out of the bracket 416.

FIG. 4D shows an angled view of the bracket 416 with the portion 400 of arm rest assembly and the glides 406, shown in FIGS. 4A-C, consistent with various aspects of the present disclosure. The portion 400 of arm rest assembly may slide within the bracket 416 in the directions indicated by arrow 418.

FIG. 4E shows a side view of the bracket with the portion of arm rest assembly and the glide, shown in FIGS. 4A-D, consistent with various aspects of the present disclosure. The recessed surface 412 provides a pathway for the portion 400 of the arm rest assembly. The recessed surface 412 may raise the portion 400 of the arm rest assembly above the bracket 416 for a consistent and smooth pathway for the portion 400 of the arm rest assembly.

The illustrative components shown in FIGS. 4A-E are not intended to suggest any limitation as to the scope of use or functionality of embodiments of the disclosed subject matter. Neither should the illustrative components be interpreted as having any dependency or requirement related to any single component or combination of components illustrated therein. Additionally, any one or more of the components depicted in any of the FIGS. 4A-E may be, in embodiments, integrated with various other components depicted therein (and/or components not illustrated), all of which are considered to be within the ambit of the disclosed subject matter. For example, the bracket 416 may include forming a lever as shown and described below with reference to FIG. 5 and FIGS. 6A-B.

Figure 5:
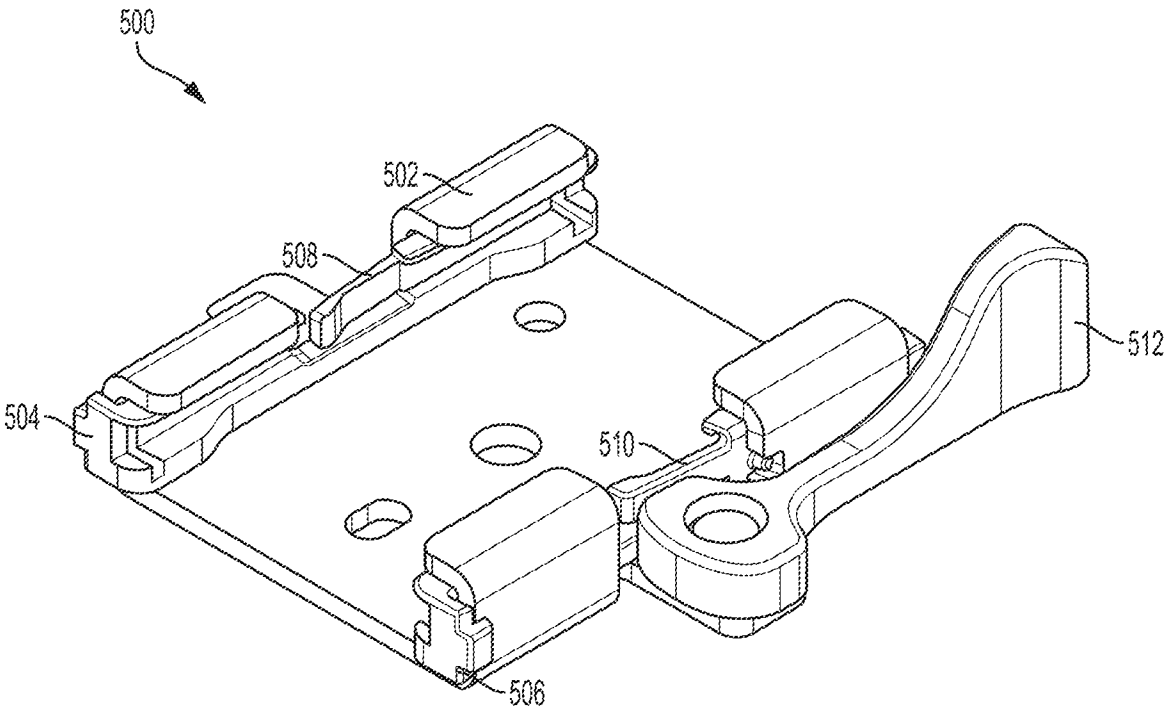
FIG. 5 shows an example bracket assembly, consistent with various aspects of the present disclosure.

FIG. 5 shows an example bracket assembly 500, consistent with various aspects of the present disclosure. The bracket assembly 500 may be coupled to a chair seat (e.g., as shown in FIGS. 1-2) and configured to releasably couple an arm rest assembly to the chair seat (e.g., as shown in FIG. 1). In addition, the bracket assembly 500 may be configured to facilitate adjusting a width for the arm rest assembly relative to the chair seat.

The arm rest assembly may include an upright having a vertical portion and a horizontal portion as shown in FIG. 1. The horizontal portion of the arm rest assembly may be configured to: slide within the bracket assembly 500 for the user to releasably couple the arm rest assembly to the chair seat, and adjust the width for the arm rest assembly relative to the chair seat. As also noted above with respect to FIG. 1, portions of a chair may be separately packed together for assembly by a user. The user may receive the portions of the chair after purchasing a package containing the chair. In certain instances, the bracket assembly 500 may be separated from the arm rest assembly. Thus, the user may slide the horizontal portion of arm rest assembly within the bracket 500 for the user to releasably couple the arm rest assembly to the chair seat.

The bracket assembly 500 may be configured to mitigate against removal of the arm rest assembly from the bracket subsequent to releasably coupling the arm rest assembly thereto. For example, the bracket assembly 500 may include a bracket portion 502 and glides 504, 506 coupled thereto. The glides 504, 506 may be configured to stop the arm rest assembly from removal from the bracket subsequent to releasably coupling the arm rest assembly thereto. The glides 504, 506 may include snap-features 508, 510 that couple to parts of the horizontal portion of arm rest assembly and which may provide a stop for the horizontal portion of arm rest assembly (e.g., as detailed above with reference to FIGS. 4A-E).

The bracket assembly 500 may also include a lever 512 coupled to the bracket portion 502 and configured to immobilize the arm rest assembly within the bracket. The lever 512 may be configured to actuate between a locked position (as shown in FIG. 5) and an unlocked position. In certain instances, the lever 512 may be configured to push the glides 504, 506 inward against the horizontal portion of the arm rest assembly in the locked position to immobilize the arm rest assembly within the bracket.

Figure 6B:
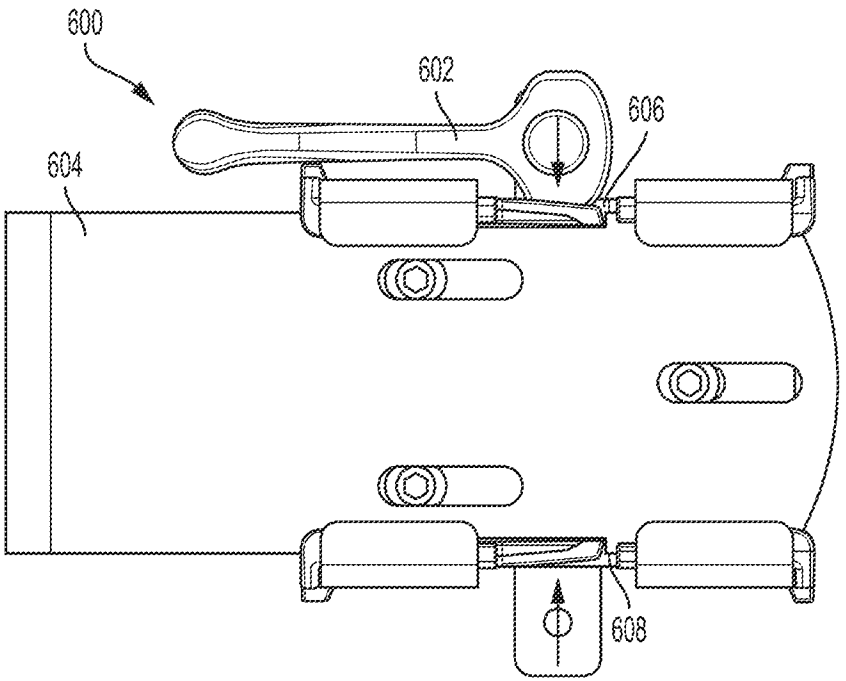
FIG. 6B shows the bracket assembly and lever, shown in FIG. 6A, in a locked position, consistent with various aspects of the present disclosure.
Figure 6A:
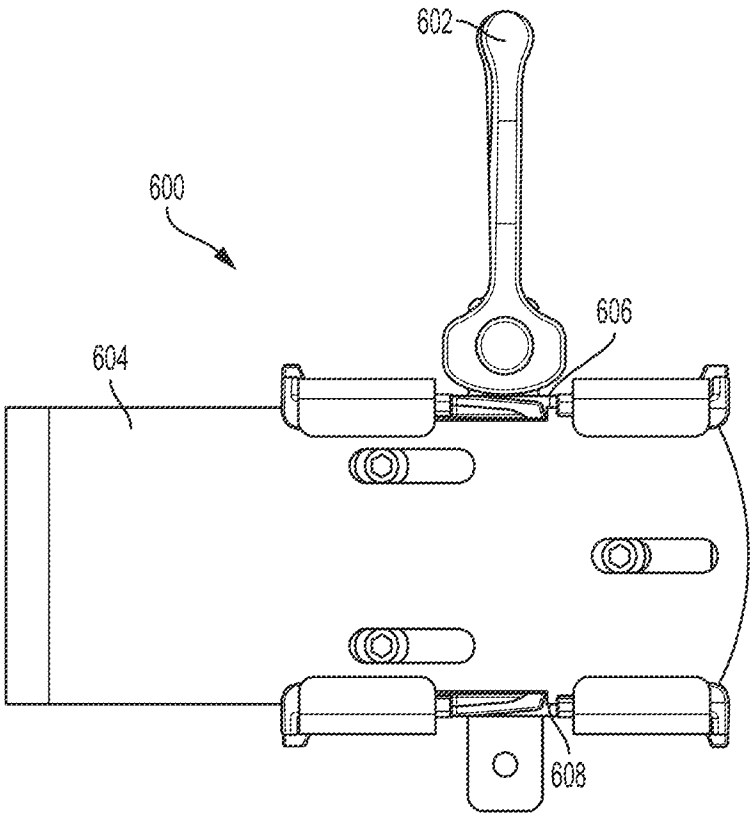
FIG. 6A shows an example bracket assembly and lever in an unlocked position, consistent with various aspects of the present disclosure.

FIG. 6A shows an example bracket assembly 600 and lever 602 in an unlocked position, consistent with various aspects of the present disclosure. The bracket assembly 600 may be coupled to a chair seat (e.g., as shown in FIGS. 1-2) and configured to releasably couple an arm rest assembly to the chair seat (e.g., as shown in FIG. 1). In addition, the bracket assembly 600 may be configured to facilitate adjusting a width for the arm rest assembly relative to the chair seat.

The arm rest assembly may include an upright having a vertical portion and a horizontal portion 604. The horizontal portion 604 of the arm rest assembly may be configured to slide within the bracket assembly 600 for the user to releasably couple the arm rest assembly to the chair seat. In addition, the bracket assembly 600 may also be configured to allow the horizontal portion 604 to slide therein to adjust the width for the arm rest assembly relative to the chair seat. As also noted above with respect to FIG. 1, portions of a chair may be separately packed together for assembly by a user. The user may receive the portions of the chair after purchasing a package containing the chair. In certain instances, the bracket assembly 600 may be separated from the arm rest assembly. Thus, the user may slide the horizontal portion 604 of arm rest assembly within the bracket assembly 600 for the user to releasably couple the arm rest assembly to the chair seat.

The bracket assembly 600 may include a lever 602 coupled to the bracket and configured to releasably lock the arm rest assembly (e.g., the horizontal portion 604 of the arm assembly) within the bracket assembly 600 at a desired width for the arm rest assembly relative to the chair seat. In certain instances, the lever 602 may be configured to immobilize the horizontal portion 604 of the arm rest assembly within the bracket assembly 600. For example, the lever 602 may be configured to compress the horizontal portion 604 of the arm rest assembly against the bracket assembly 600 in the locked position as is shown in FIG. 6B. In certain instances, the bracket assembly 600 may include glides 606, 608 that facilitate movement/sliding of the horizontal portion 604 of the arm rest assembly within the bracket assembly 600.

FIG. 6B shows the bracket assembly 600 and lever 602, shown in FIG. 6A, in a locked position, consistent with various aspects of the present disclosure. The lever 602 may compress portions of the glides 606, 608 against the horizontal portion 604 of the arm rest assembly in the locked position. The glides 606, 608 are uncompressed when the lever 602 is in the unlocked position. The lever 602 may be configured to rotate, relative to the bracket assembly 600, between the locked position and the unlocked position. The lever 602 may be attached to the bracket assembly 600 via a pin (e.g., rivet, screw, roll pin) that allows for rotation of the lever 602 relative to the bracket assembly 600. A user may rotate the lever 602 to the locked position once the horizontal portion 604 of the arm assembly is slid within the bracket assembly 600 such that a desired width for the arm assembly is achieved.

The illustrative components shown in FIGS. 6A-B are not intended to suggest any limitation as to the scope of use or functionality of embodiments of the disclosed subject matter. Neither should the illustrative components be interpreted as having any dependency or requirement related to any single component or combination of components illustrated therein. Additionally, any one or more of the components depicted in any of the FIGS. 6A-B may be, in embodiments, integrated with various other components depicted therein (and/or components not illustrated), all of which are considered to be within the ambit of the disclosed subject matter. For example, the glides 606, 608 may include snap-features and the horizontal portion 604 may include notches as discussed above with reference to FIGS. 4A-E.

Figure 7B:
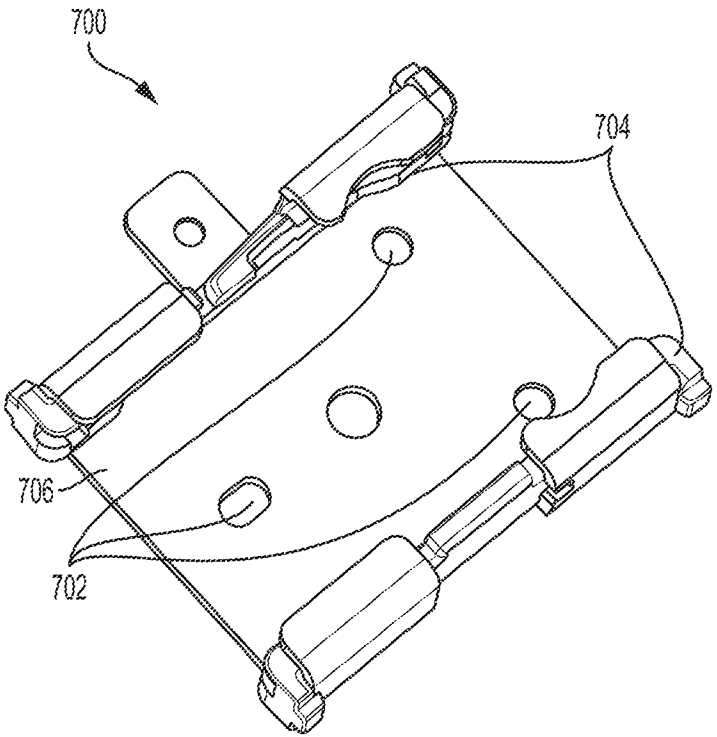
FIG. 7B shows the bracket, shown in FIG. 7A, and glides, consistent with various aspects of the present disclosure.
Figure 7A:
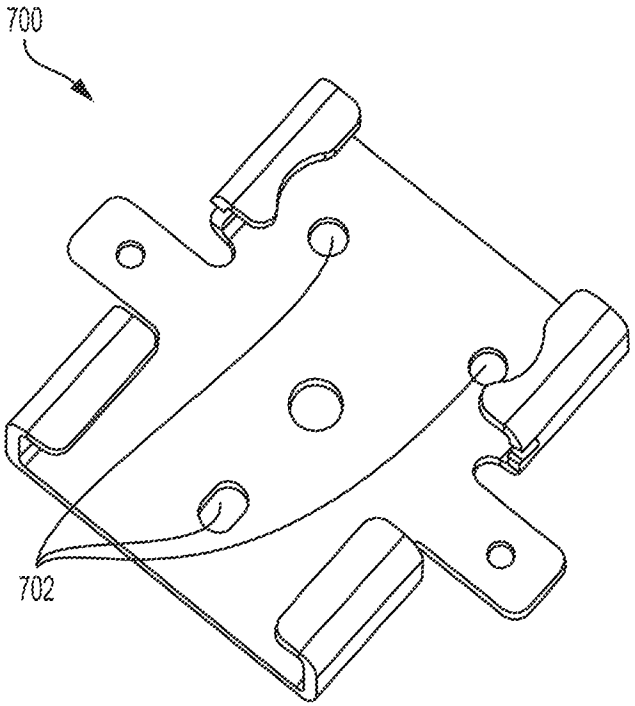
FIG. 7A shows an example bracket, consistent with various aspects of the present disclosure.

FIG. 7A shows an example bracket 700, consistent with various aspects of the present disclosure. The bracket 700 may include one or more holes 702 to facilitate attachment of the bracket 700 to a chair seat (e.g., as shown in FIGS. 1-2). The bracket 700 may be secured to the chair seat (not shown) by one or more attachment mechanisms (such as screws, bolts, rivets, or other similar devices) arranged through the holes 702 and into the chair seat. The bracket 700 may also include an orientation feature (e.g., as shown in FIG. 8C) to assist a user in assembly. In instances where the bracket 700 includes the orientation feature, the orientation feature may indicate a proper orientation for the bracket 700 in attaching to the chair seat.

The bracket 700 may be configured to releasably couple an arm rest assembly (e.g., shown in FIG. 1) to the chair seat. In certain instances, the bracket 700 may also be configured to facilitate adjusting a width for the arm rest assembly relative to the chair seat. As shown in FIG. 7B, the bracket 700 may include the glides 704. The glides 704 may facilitate adjusting the width for the arm rest assembly relative to the chair seat. The glides 704 may be configured as a pathway for a horizontal portion of the arm rest assembly to slide as discussed in further detail above with reference to, for example, FIG. 3B.

Figure 8A:
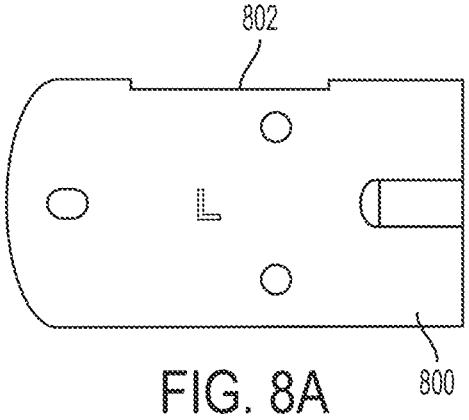
FIG. 8A shows a portion of another example arm rest assembly, consistent with various aspects of the present disclosure.

FIG. 8A shows a portion 800 of another example arm rest assembly, consistent with various aspects of the present disclosure. The portion 800 may be a horizontal portion of an arm rest assembly (e.g., as shown in FIG. 1). The portion 800 may extend inwardly toward a chair seat (not shown). The portion 800 of the arm rest assembly may be configured to interface with more a first glide 804*a* and a second glide 804*b* shown in FIGS. 8B-C. In certain instances, the portion 800 of the arm rest assembly may include a notch 802 that interface with one of the first glide 804*a* and the second glide 804*b*.

Figure 8B:
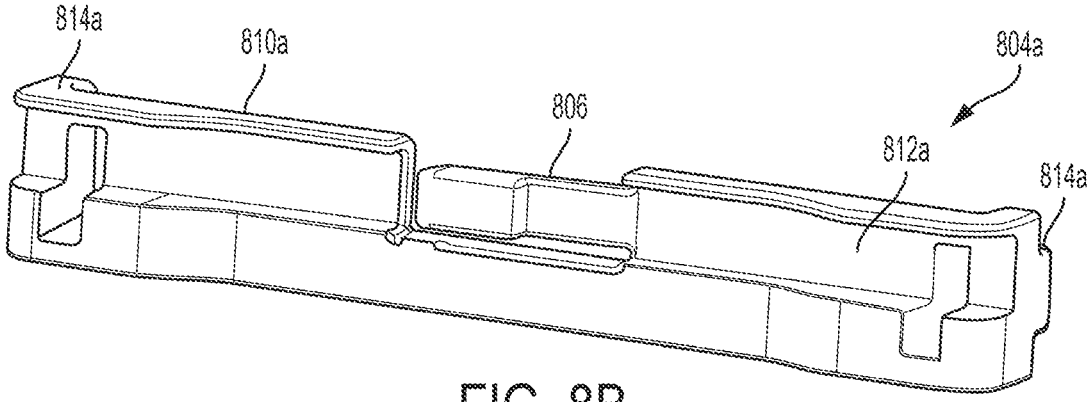
FIG. 8B shows an example first glide, consistent with various aspects of the present disclosure.
Figure 8C:
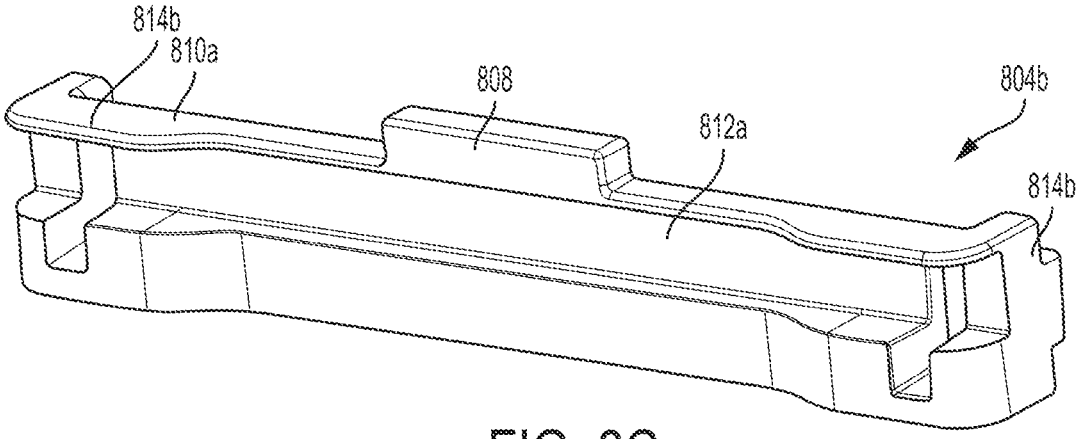
FIG. 8C shows an example second glide, consistent with various aspects of the present disclosure.

As shown in FIG. 8B, the first glide 804*a* may include a snap-feature 806 that is configured to interface with the notch 802. The snap-feature 806 may be a tab that projects inwardly from an exterior surface 810*a* of the first glide 804*a*. In addition, the first glide 804*a* may include a recessed surface 812*a* that provides a pathway for the portion 800 of the arm rest assembly shown in FIG. 8A. In certain instances, the first glide 804*a* may include external features 814*a* that are configured to engage a bracket 816 as shown in FIG. 8D.

As shown in FIG. 8C, the second glide 804*b* may include an orientation feature 808 that is configured to facilitate orientation of the second glide 804*b* in assembly of a chair. The orientation feature 808 may be positioned within a portion of the bracket 816 to facilitate correct assembly of the second glide 804*b* with the bracket 816 as shown in further detail in FIG. 8F. In addition, the second glide 804*b* may include an exterior surface 810*b* and a recessed surface 812*b* that provides a pathway for the portion 800 of the arm rest assembly shown in FIG. 8A. In certain instances, the second glide 804*b* may include external features 814*b* that are configured to engage the bracket 816 as shown in FIG. 8D.

Figure 8D:
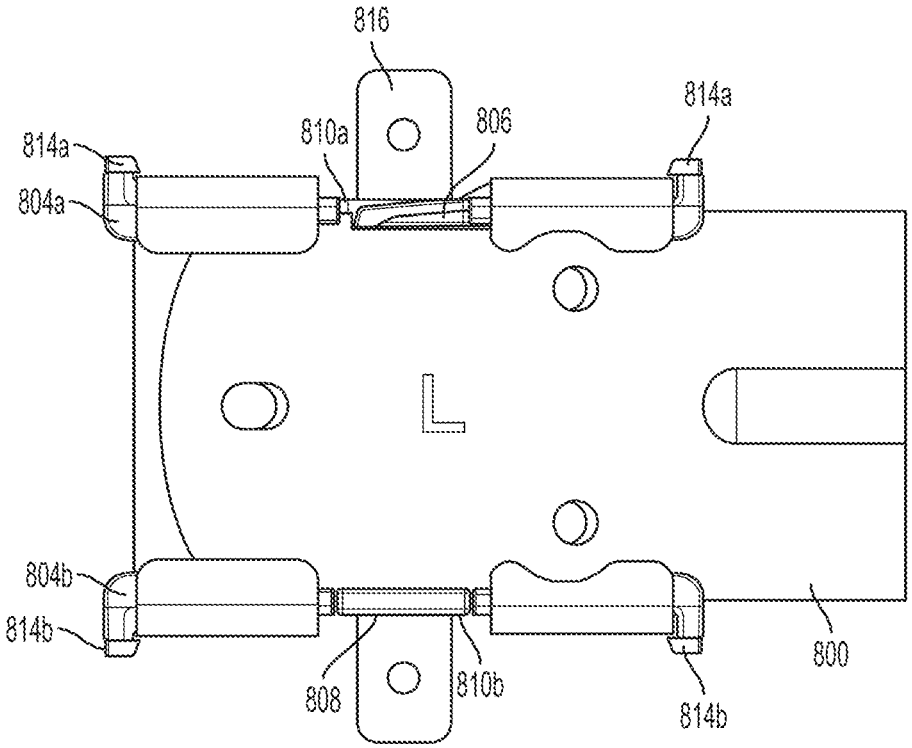
FIG. 8D shows a top view of an example bracket with the portion of arm rest assembly, the first glide, and the second glide, shown in FIGS. 8A-C, consistent with various aspects of the present disclosure.

FIG. 8D shows a top view of the bracket 816 with the portion 800 of arm rest assembly, the first glide 804*a*, and the second glide 804*b*, shown in FIGS. 8A-C, consistent with various aspects of the present disclosure. The bracket 816 may be coupled to a lower portion of a chair seat (e.g., as shown in FIGS. 1-2). In addition, the bracket 816 may be configured to releasably couple the arm rest assembly to the chair seat and facilitate adjusting a width for the arm rest assembly relative to the chair seat. In addition, the bracket 816 may be configured to releasably couple the portion 800 of arm rest assembly to the chair seat and facilitate adjusting a width for the arm rest assembly relative to the chair seat. The portion 800 of arm rest assembly may be configured to slide within the first glide 804*a* and the second glide 804*b* (within the bracket 816) for the user to releasably couple the arm rest assembly to the chair seat, and adjust the width for the arm rest assembly relative to the chair seat.

In addition, the portions of a chair may be separately packed together for assembly by a user (e.g., as noted above with respect to FIG. 1). The user may receive the portions of the chair after purchasing a package containing the chair. In certain instances, the bracket 816, the first glide 804*a*, and/or the second glide 804*b* may be separated from the arm rest assembly. The user may attach the first glide 804*a* and the second glide 804*b* to the bracket 816. The orientation feature 808 may visually indicate to the user the correct orientation for locating the second glide 804*b* within the bracket 816. Due to the symmetrical nature of the second glide 804*b* and the first glide 804*a*, the user may deduce the orientation for arranging the first glide 804*a* within the bracket 816.

In certain instances, the first glide 804*a* may be configured to stop the arm rest assembly (e.g., the portion 800 of arm rest assembly) from removal from the bracket subsequent to releasably coupling the arm rest assembly thereto. For example, the notch 802 in the portion 800 of arm rest assembly may snap into the snap-feature 806 of the first glide 804*a*. The first glide 804*a* may be configured as a stop for the portion 800 of arm rest assembly such that once the portion 800 of arm rest assembly is pushed passed the snap-feature 806 and the notch 802 are engaged, the portion 800 of arm rest assembly may not be removed from the bracket 816 without user intervention. The notch 802 may be configured to unsnap from the snap-feature 806 of the first glide 804*a* in response to intervention of the user (e.g., the user intentionally forces the snap-feature 806 of the first glide 804*a* out of the notch 802). In certain instances, the amount of movement of the portion 800 of arm rest assembly within the bracket 816 is approximately equal to a length of the notch 802. For example, the snap-feature 806 of the first glide 804*a* may be a stop mechanism such that sidewalls of the notch 802 contact the snap-feature 806 of the first glide 804*a*, which stops the portion 800 of arm rest assembly from sliding past the snap-feature 806 of the first glide 804*a*, and out of the bracket 816.

Figure 8E:
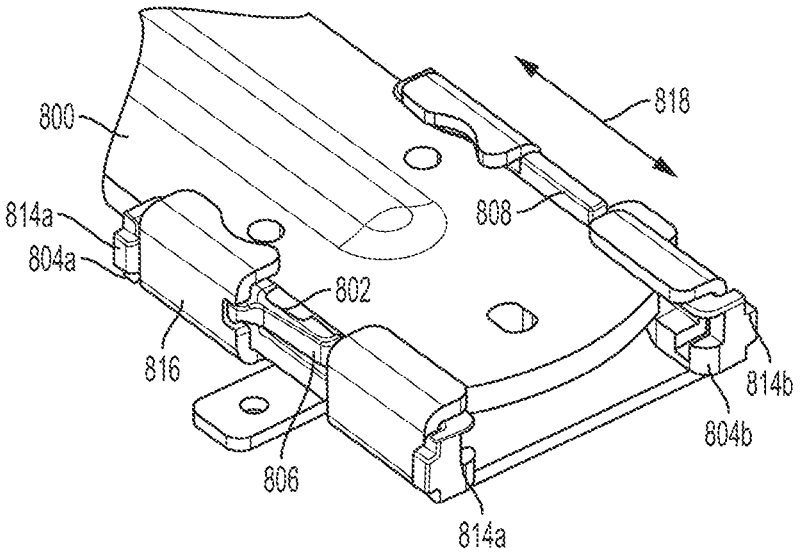
FIG. 8E shows an angled view of the bracket with the portion of arm rest assembly and the first glide and the second glide, shown in FIGS. 8A-D, consistent with various aspects of the present disclosure.

FIG. 8E shows an angled view of the bracket 816 with the portion 800 of arm rest assembly and the first glide 804*a* and the second glide 804*b*, shown in FIGS. 8A-D, consistent with various aspects of the present disclosure. The portion 800 of the arm rest assembly may slide within the bracket 816 in the directions indicated by arrow 818.

Figure 8F:
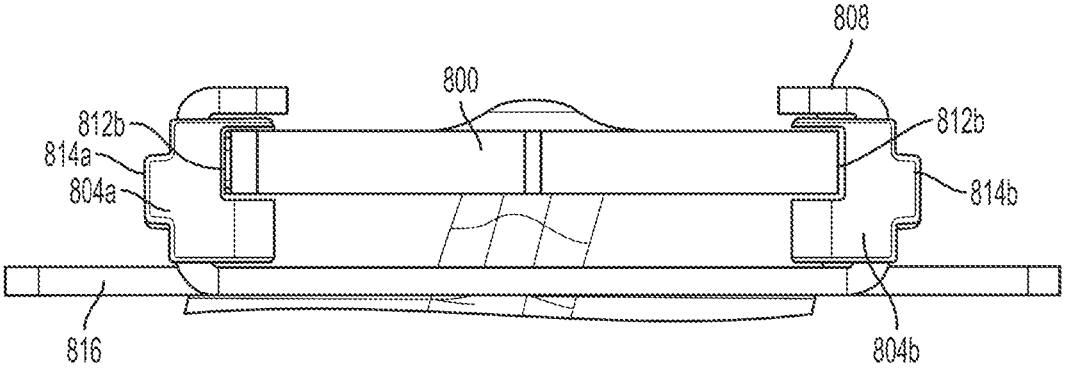
FIG. 8F shows a side view of the bracket with the portion of arm rest assembly and the first glide and the second glide, shown in FIGS. 8A-E, consistent with various aspects of the present disclosure.

FIG. 8F shows a side view of the bracket 816 with the portion 800 of arm rest assembly and the first glide 804*a* and the second glide 804*b*, shown in FIGS. 8A-E, consistent with various aspects of the present disclosure. The recessed surfaces 812*a*, 812*b* of the first glide 804*a* and the second glide 804*b* provide a pathway for the portion 800 of the arm rest assembly. The recessed surfaces 812*a*, 812*b* may raise the portion 800 of the arm rest assembly above the bracket 816 for a consistent and smooth pathway for the portion 800 of the arm rest assembly.

The illustrative components shown in FIGS. 8A-F are not intended to suggest any limitation as to the scope of use or functionality of embodiments of the disclosed subject matter. Neither should the illustrative components be interpreted as having any dependency or requirement related to any single component or combination of components illustrated therein. Additionally, any one or more of the components depicted in any of the FIGS. 8A-F may be, in embodiments, integrated with various other components depicted therein (and/or components not illustrated), all of which are considered to be within the ambit of the disclosed subject matter. For example, the bracket 816 may include forming a lever as shown and described below with reference to FIG. 5, FIGS. 6A-B, FIG. 9, and/or FIGS. 10A-B.

Figure 9:
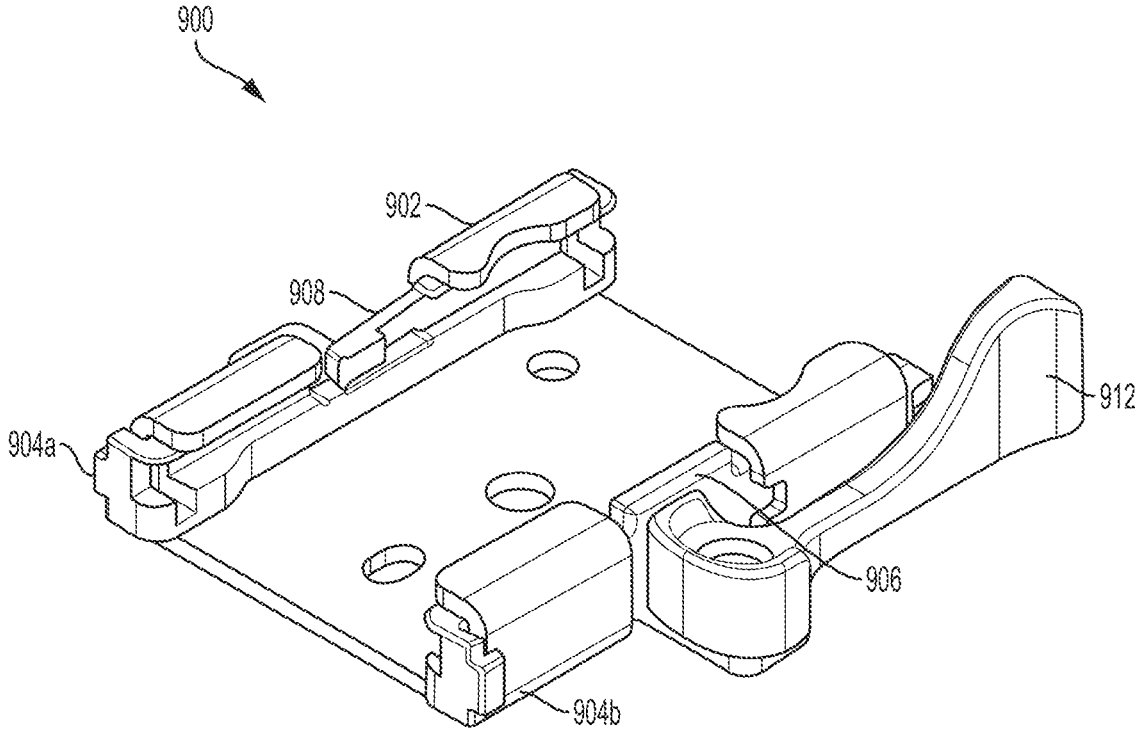
FIG. 9 shows another example bracket assembly, consistent with various aspects of the present disclosure.

FIG. 9 shows another example bracket assembly 900, consistent with various aspects of the present disclosure. The bracket assembly 900 may be coupled to a chair seat (e.g., as shown in FIGS. 1-2) and configured to releasably couple an arm rest assembly to the chair seat (e.g., as shown in FIG. 1). In addition, the bracket assembly 900 may be configured to facilitate adjusting a width for the arm rest assembly relative to the chair seat.

The bracket assembly 900 may be configured to mitigate against removal of an arm rest assembly from the bracket subsequent to releasably coupling the arm rest assembly thereto. For example, the bracket assembly 900 may include a bracket portion 902 and glides 904*a*, 904*b* coupled thereto. The glides 904*a*, 904*b* may be configured to stop the arm rest assembly from removal from the bracket subsequent to releasably coupling the arm rest assembly thereto. One of the glides 904*a*, 904*b* (glide 904*a*) may include a snap-feature 908 that couple to parts of the horizontal portion of arm rest assembly and which may provide a stop for the horizontal portion of arm rest assembly (e.g., as detailed above with reference to FIGS. 4A-E and FIGS. 8A-F). The other of the glides 904*a*, 904*b* (glide 904*b*) may include an orientation feature 906. The orientation feature 906 may visually indicate to the user the correct orientation for locating the glide 904*b* within the bracket portion 902.

The bracket assembly 900 may also include a lever 912 coupled to the bracket portion 902 and configured to immobilize the arm rest assembly within the bracket. The lever 912 may be configured to actuate between a locked position (as shown in FIG. 9) and an unlocked position. In certain instances, the lever 912 may be configured to push the orientation feature 906 of the glide 904*b* inward against the horizontal portion of the arm rest assembly in the locked position to immobilize the arm rest assembly within the bracket. The orientation feature 906 may facilitate frictional engagement between the horizontal portion of the arm rest assembly and the lever 912.

Figure 10B:
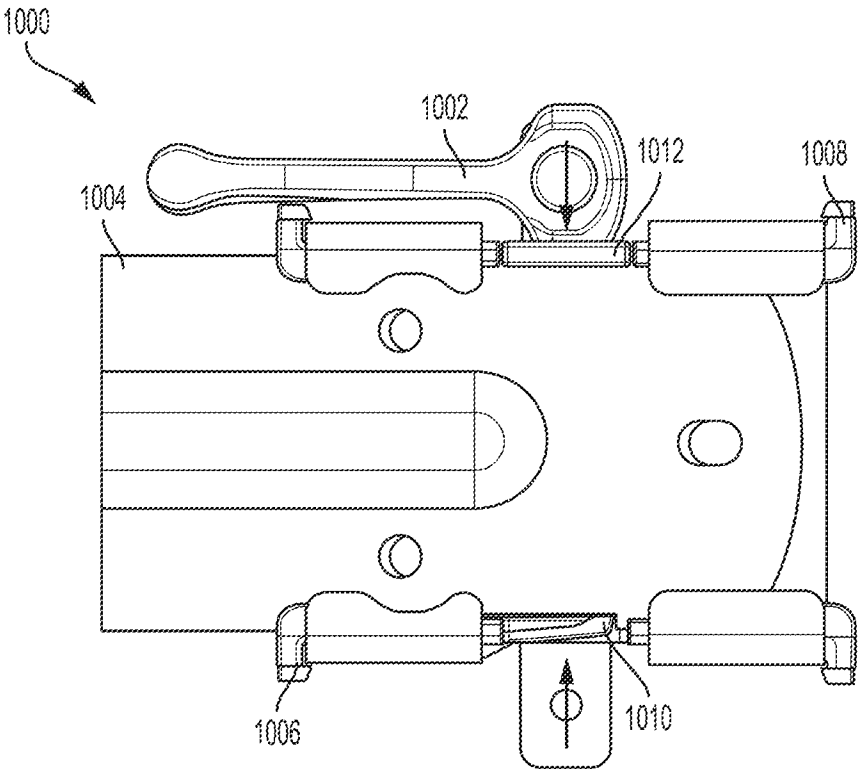
FIG. 10B shows the bracket assembly and lever, shown in FIG. 10A, in a locked position, consistent with various aspects of the present disclosure.
Figure 10A:
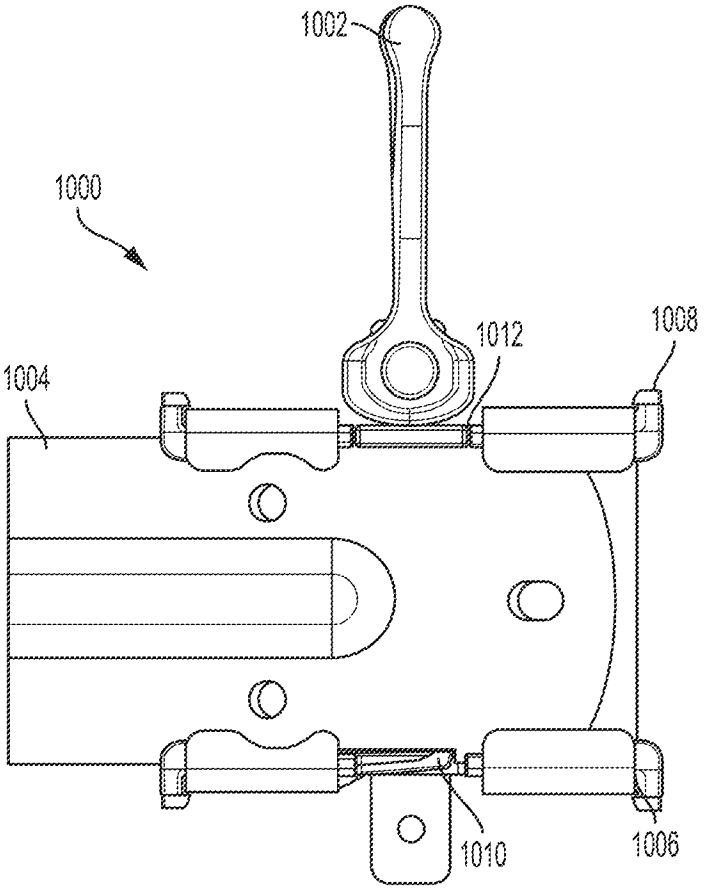
FIG. 10A shows an example bracket assembly and lever in an unlocked position, consistent with various aspects of the present disclosure.

FIG. 10A shows an example bracket assembly 1000 and lever 1002 in an unlocked position, consistent with various aspects of the present disclosure. The arm rest assembly may include an upright having a vertical portion and a horizontal portion 1004. The bracket assembly 1000 may also be configured to allow the horizontal portion 1004 to slide therein to adjust the width for the arm rest assembly relative to the chair seat. In addition, the horizontal portion 1004 of the arm rest assembly may be configured to slide within the bracket assembly 1000 for the user to releasably couple the arm rest assembly to the chair seat.

The bracket assembly 1000 may include a lever 1002 coupled to the bracket and configured to releasably lock the arm rest assembly (e.g., the horizontal portion 1004 of the arm assembly) within the bracket assembly 1000 at a desired width for the arm rest assembly relative to the chair seat. In certain instances, the lever 1002 may be configured to immobilize the horizontal portion 1004 of the arm rest assembly within the bracket assembly 1000. For example, the lever 1002 may be configured to compress the horizontal portion 1004 of the arm rest assembly against the bracket assembly 1000 in the locked position as is shown in FIG. 6B. In certain instances, the bracket assembly 1000 may include glides 1006, 1008 that facilitate movement/sliding of the horizontal portion 1004 of the arm rest assembly within the bracket assembly 1000. Glide 1006 may include a snap-fit feature 1010 (e.g., as discussed above with reference to FIGS. 8-9). In addition and as shown in FIG. 10A, the glide 1008 includes a flat surface 1012 opposite that of the snap-fit feature 1010 that may facilitate the lever 1002 engaging the horizontal portion 1004 to lock the horizontal portion 1004 within the bracket assembly 1000.

FIG. 10B shows the bracket assembly 1000 and the lever 1002, shown in FIG. 10A, in a locked position, consistent with various aspects of the present disclosure. The lever 1002 may compress the flat surface 1012 of the glide 1008 against the horizontal portion 1004 of the arm rest assembly in the locked position. The glides 1006, 1008 are uncompressed when the lever is in the unlocked position. The lever 1002 may be configured to rotate, relative to the bracket assembly 1000, between the locked position and the unlocked position. The lever 1002 may be attached to the bracket assembly 1000 via a pin (e.g., rivet, screw, roll pin) that allows for rotation of the lever 1002 relative to the bracket assembly 1000. A user may rotate the lever 1002 to the locked position once the horizontal portion 1004 of the arm assembly is slid within the bracket assembly 1000 such that a desired width for the arm assembly is achieved.

Figure 11:
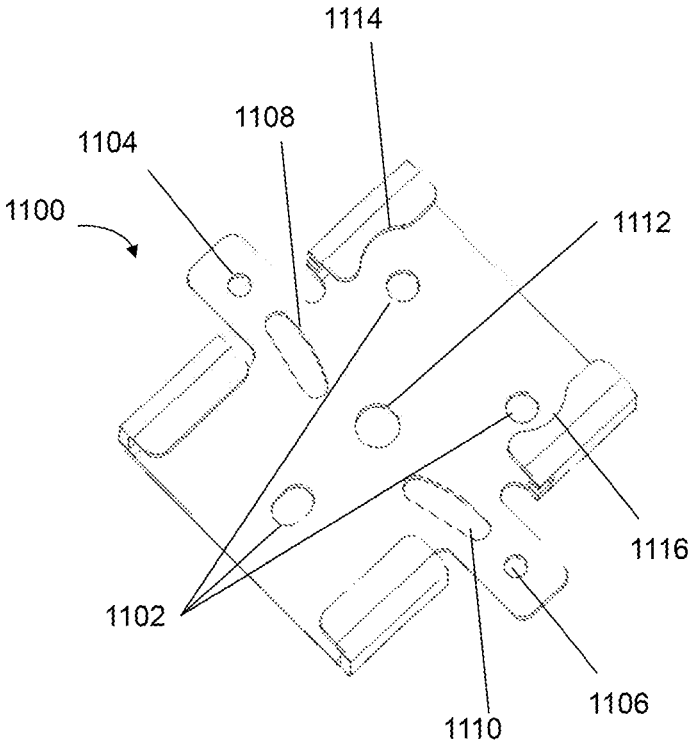
FIG. 11 shows another example bracket, consistent with various aspects of the present disclosure.
Figure 12A:
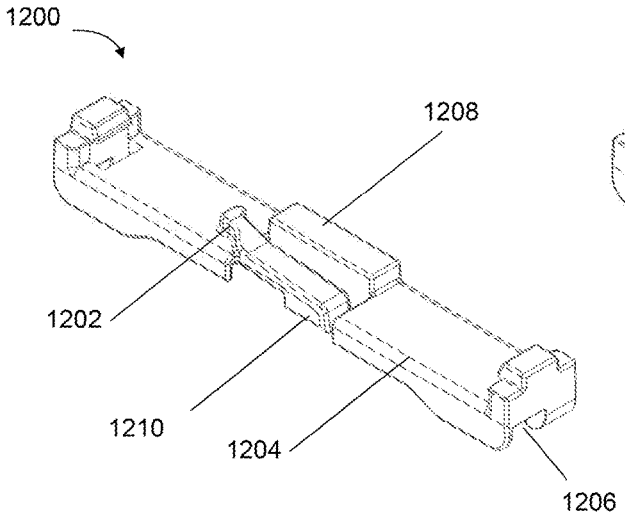
FIG. 12A shows a first view of another example first glide, consistent with various aspects of the present disclosure.
Figure 12B:
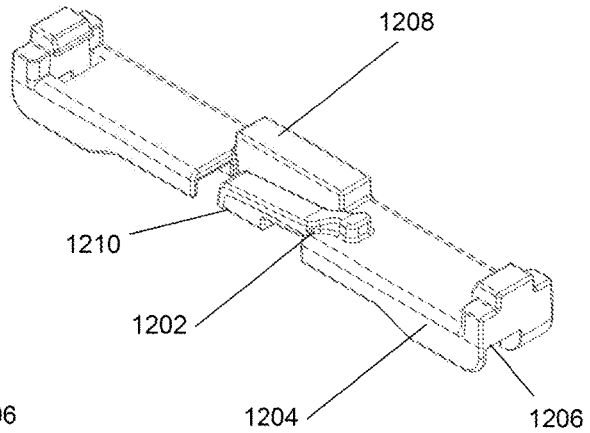
FIG. 12B shows a second view of the first glide shown in FIG. 12A, consistent with various aspects of the present disclosure.
Figure 12C:
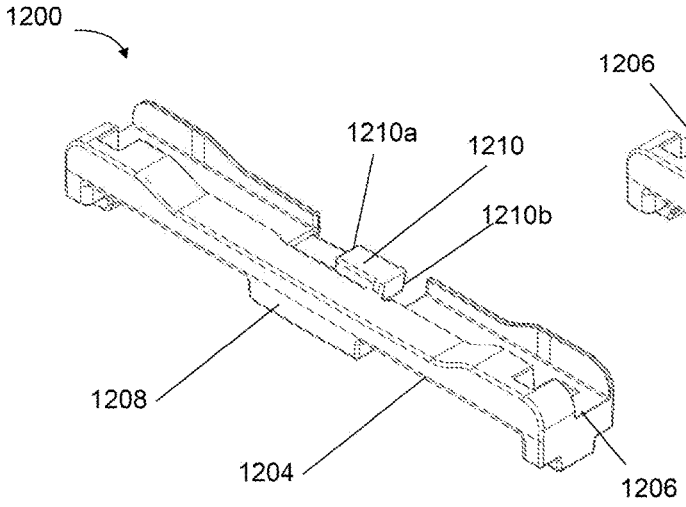
FIG. 12C shows a third view of the first glide shown in FIGS. 12A-B, consistent with various aspects of the present disclosure.
Figure 12D:
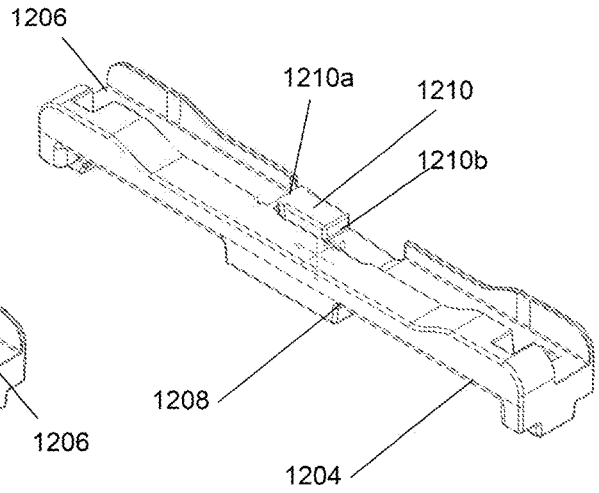
FIG. 12D shows a fourth view of the first glide shown in FIGS. 12A-C, consistent with various aspects of the present disclosure.

FIG. 11 shows another example bracket 1100, consistent with various aspects of the present disclosure. The bracket 1100 may include one or more holes 1102 to facilitate attachment of the bracket 300 to a chair seat (e.g., as shown in FIGS. 1-2). The bracket 1100 may be secured to the chair seat (not shown) by one or more attachment mechanisms (such as screws, bolts, rivets, or other similar devices) arranged through the holes 1102 and into the chair seat.

Figure 13A:
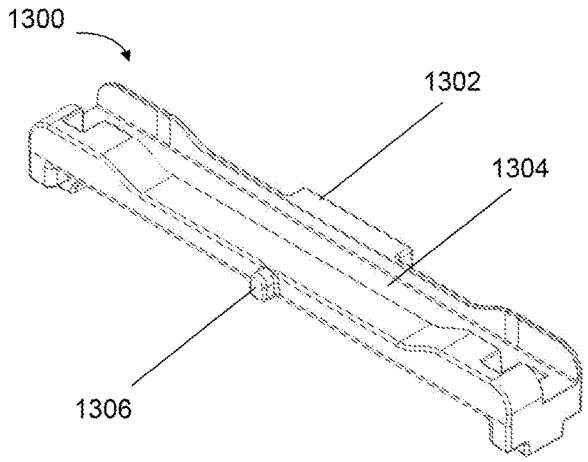
FIG. 13A shows a first view of another example second glide, consistent with various aspects of the present disclosure.
Figure 13B:
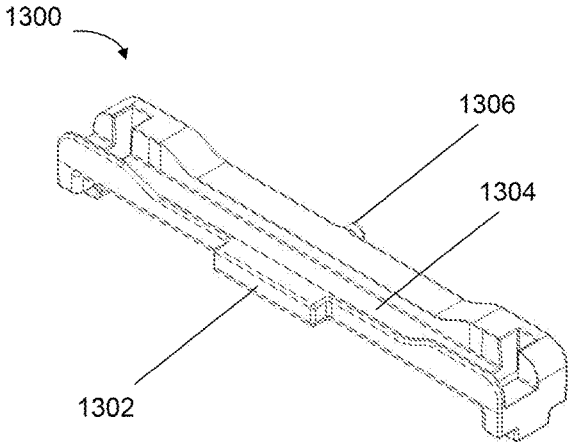
FIG. 13B shows a second view of the second glide shown in FIG. 13A, consistent with various aspects of the present disclosure.

In certain instances, the bracket 1100 includes openings 1104, 1106 (as also shown in FIG. 3B, for example) that are attachment holes for attachment of a lever (e.g., as shown in FIGS. 6A-B) through the bracket 110 to the chair seat (not shown). Further, the bracket 1100 may also include features 1108, 1110 that facilitate coupling of glides (not shown) to the bracket 1110. The glides may include corresponding features (e.g., as shown in FIGS. 13A-B) that facilitate assembly of the glides with the bracket 1110 in a proper and desired arrangement. In addition, the bracket 1100 can include a hole 1112 that facilitates coupling and removal of the bracket 110 from a die carrier. Upper portions of the bracket 1100 may include cut-outs 1114, 1116 adjacent to openings 1110 that are near the perimeter of the bracket 1110. The cut-outs 1114, 1116 facilitate use of a driver or other tool to arrange attachment mechanisms (such as screws, bolts, rivets, or other similar devices) through the openings 1110.

Figure 14:
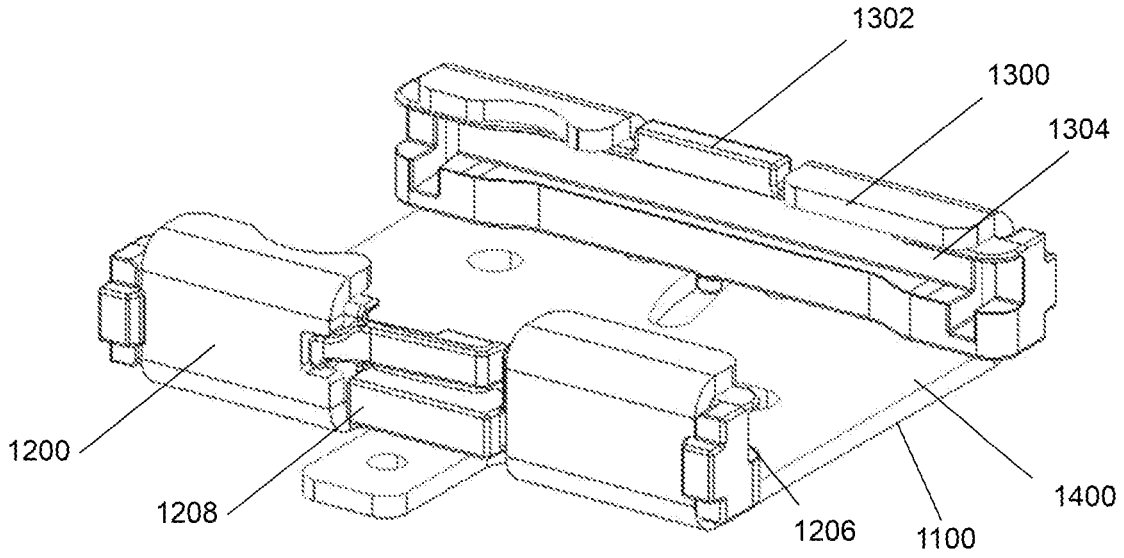
FIG. 14 shows another example bracket and glides, consistent with various aspects of the present disclosure.
Figure 15:
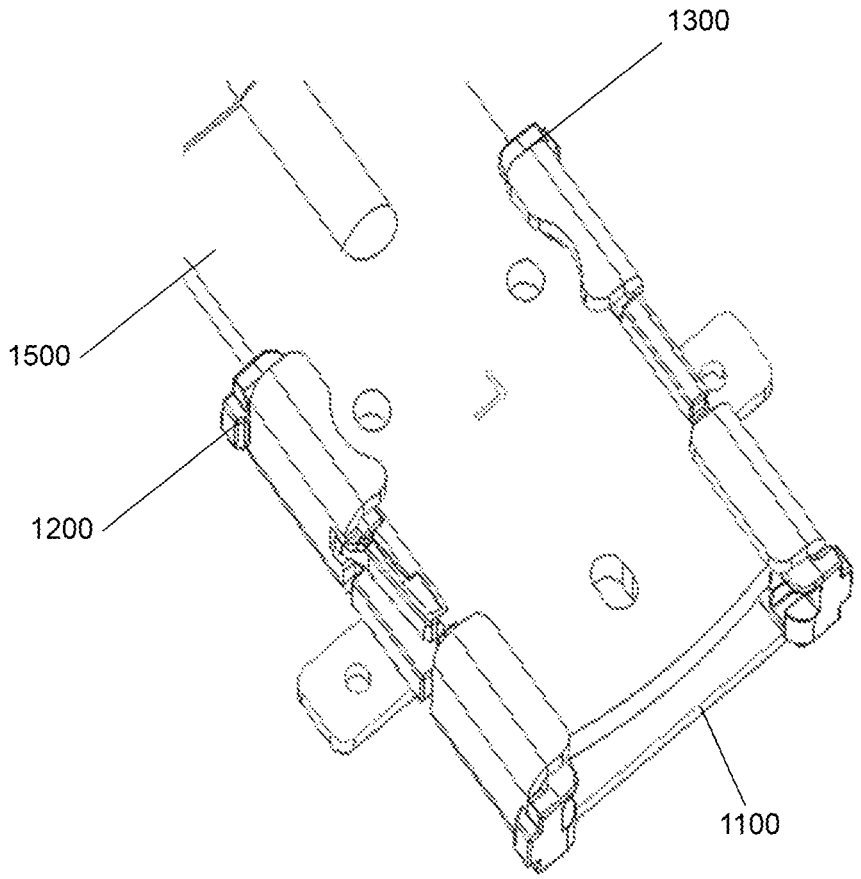
FIG. 15 shows an angled view of an example bracket, a portion of arm rest assembly, and glides, consistent with various aspects of the present disclosure.

FIGS. 12A-D shows views of another example first glide 1200, consistent with various aspects of the present disclosure. The first glide 1200 include a guide-feature 1202 that is configured to interface with a notch in a bracket (e.g., as shown in FIGS. 14-15). The guide-feature 1202 may be a tab that projects from an exterior surface 1204 of the first glide 1200. The exterior surface 1204 of the first glide 1200 interfaces with a bracket and does not provide a slideable pathway for a portion of the arm rest assembly shown in FIGS. 15-17. An interior surface 1206 of the first glide 1200 provides a slideable pathway for a portion of the arm rest assembly shown in FIGS. 15-17.

Figure 19:
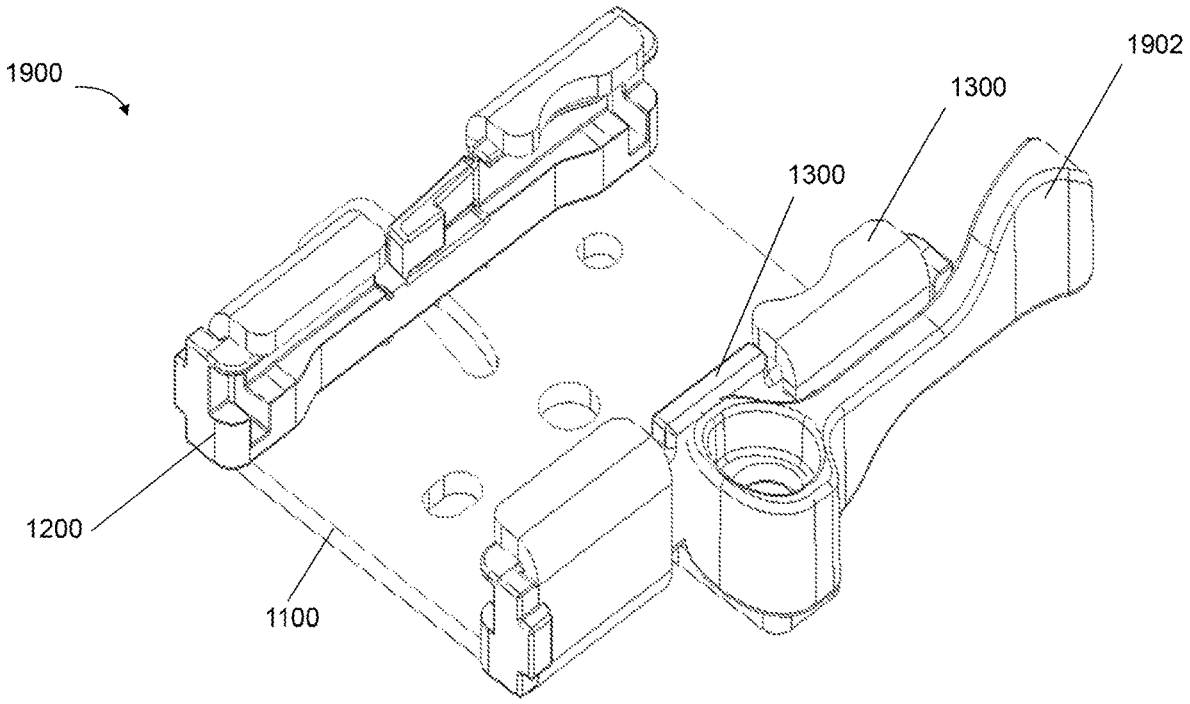
FIG. 19 shows another example bracket assembly, consistent with various aspects of the present disclosure.

The first glide 1200 may also include an orientation feature 1208 that prevents the installation of a lever (e.g., as shown in FIG. 19) on an improper or undesired side of the bracket. The orientation feature 1208 is located on the exterior surface 1204 of the first glide 1200 vertically offset from the guide-feature 1202 to slow within a bracket as shown in FIG. 14. The guide-feature 1202 and the orientation feature 1208 facilitate proper alignment and orientation of the first glide 1200 within a bracket during assembly.

Along the interior surface 1206 of the first glide 1200 may be a stop mechanism 1210. The stop mechanism 1210 projects inwardly relative to the interior surface 1206 (slideable surface) of the first glide 1206. The stop mechanism 1210 is configured to interface with a portion of the of arm rest assembly to stop the portion of the of arm rest assembly from sliding past the stop mechanism 1210 of the first glide 1200, and out of the bracket as is discussed in further detail with reference to FIG. 18. The stop mechanism 1210 includes an inward stop 1210*a* and an outward stop 1210*b* for bidirectional adjustment of the portion of the arm rest assembly.

FIGS. 13A-B show views of another example second glide 1300, consistent with various aspects of the present disclosure. The second glide 1300 includes an orientation feature 1302 that is configured to facilitate orientation of the second glide 1300 in assembly of a chair. The orientation feature 1302 may be positioned within a portion of the bracket (not shown) to facilitate correct assembly of the second glide 1300 with the bracket as shown in further detail in FIG. 14. In addition, the second glide 1300 may include an interior surface 1304 that provides a pathway for a portion of the arm rest assembly.

Similar to the orientation feature 1208 of the first glide 1200 shown in FIGS. 12A-D, the orientation feature 1302 prevents upside-down installation of the second glide 1300. In addition, the orientation feature 1302 also provides surface for lever (shown in FIG. 19) to act on. In certain instances, the second glide 1300 may include an additional feature 1306 that interfaces with a portion of a bracket (features 1108, 1110 shown in FIG. 11) to guide installation of the second slide 1300 into engagement with the bracket.

FIG. 14 shows another example bracket 1100 and glides 1200, 1300, consistent with various aspects of the present disclosure. In certain instances, the bracket 1100 may include the glides 1200, 1300 to facilitate adjusting the width for the arm rest assembly relative to the chair seat. The glides 1200, 1300 may be configured as a pathway for a horizontal portion of the arm rest assembly to slide. The pathway provided by the surface 1206, 1304 of the glides 1200, 1300 is raised relative to a lower surface 1400 of the bracket 1100. In addition, the glides 1200, 1300 may provide a level horizontal pathway through which the horizontal portion of the arm rest assembly may slide. The glides 1200, 1300 may grip and at least partially surround the horizontal portion of the arm rest assembly to facilitate sliding thereof. An orientation feature 1208 of the first glide 1200 may slot within the bracket 1100. The second glide 1300 includes a similar orientation feature 1302 to slot within the bracket 1100.

FIG. 15 shows an angled view of an example bracket 1100, a portion of arm rest assembly 1500, which can also be referred to as a horizontal portion of the arm rest, and glides 1200, 1300, consistent with various aspects of the present disclosure. The portion 1500 of the arm rest assembly may slide within the bracket 1100.

Figure 16:
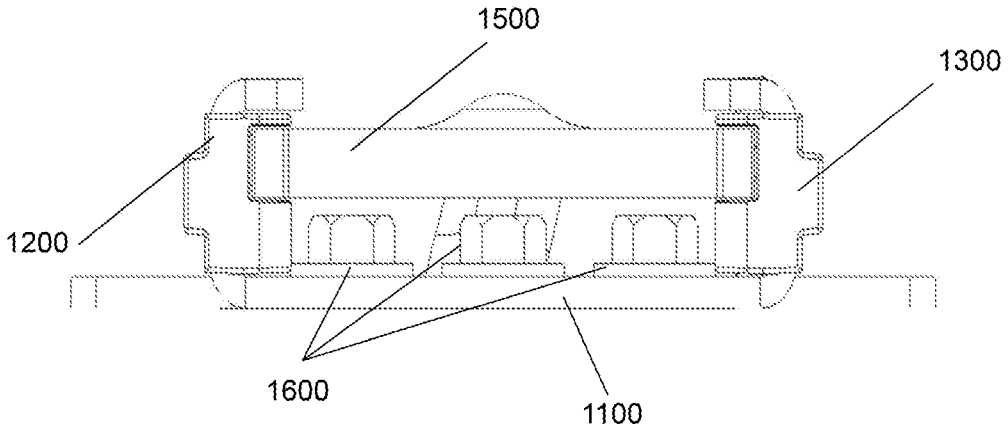
FIG. 16 shows a side view of an example bracket, a portion of arm rest assembly, and glides, consistent with various aspects of the present disclosure.

FIG. 16 shows a side view of an example bracket 1100, a portion of arm rest assembly 1500, and glides 1200, 1300, consistent with various aspects of the present disclosure. Interior or recessed surfaces of the first glide 1200 and the second glide 1300, as discussed in further detail above, provide a pathway for the portion 1500 of the arm rest assembly. The recessed surfaces may raise the portion 1500 of the arm rest assembly above the bracket 1100 for a consistent and smooth pathway for the portion 1500 of the arm rest assembly.

In addition, the glides 1200, 1300 may be both vertically and laterally offset from the bracket 1100 to provide clearance above attachment mechanisms 1600 used to attach the bracket 1100 to a chair seat. The glides 1200, 1300 being configured in this manner further facilitates a the consistent and smooth pathway for the portion 1500 of the arm rest assembly.

Figure 17:
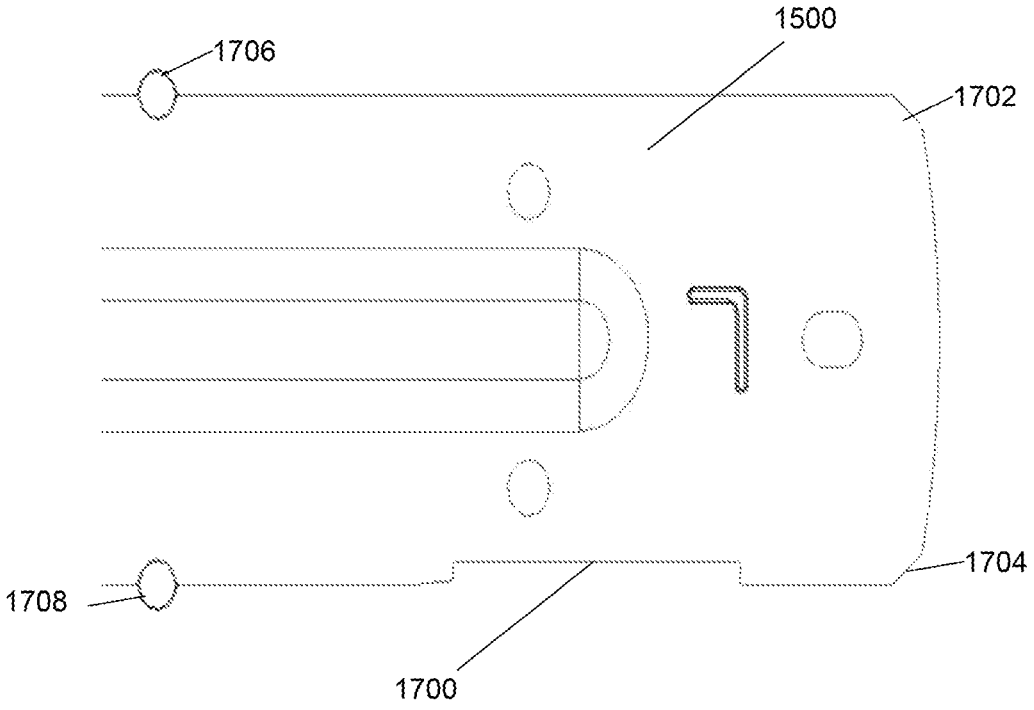
FIG. 17 shows a portion of another example arm rest assembly, consistent with various aspects of the present disclosure.

FIG. 17 shows a portion 1500 of an example arm rest assembly, consistent with various aspects of the present disclosure, as discussed above with reference to FIGS. 15-16. The portion 1500 may be a horizontal portion of an arm rest assembly (e.g., as shown in FIG. 1). The portion 1500 may extend inwardly toward a chair seat (not shown). The portion 1500 of the arm rest assembly may be configured to interface glides as discussed in detail above. In certain instances, the portion 1500 of the arm rest assembly may include a notch 1700 that interface with one of the glides.

In certain instances, the first glide 1200 may be configured to stop the arm rest assembly (e.g., the portion 1500 of arm rest assembly) from removal from the bracket 1100 (not shown in FIG. 17) subsequent to releasably coupling the arm rest assembly thereto. For example, the notch 1700 in the portion 1500 of arm rest assembly may interface with a stop mechanism 1210 of the first glide 1200. The first glide 1200 may be configured as a stop for the portion 1500 of arm rest assembly such that once the portion 1500 of arm rest assembly is pushed passed the stop mechanism 1210 and the notch 1700 are engaged, the portion 1500 of arm rest assembly may not be removed from the bracket without user intervention. The notch 1700 may be configured to unsnap from the stop mechanism 1210 of the first glide 1200 in response to intervention of the user (e.g., the user intentionally forces the stop mechanism 1210 of the first glide 1200 out of the notch 1700). In certain instances, the amount of movement of the portion 1500 of arm rest assembly within the bracket 1100 (not shown in FIG. 17) is approximately equal to a length of the notch 1700. For example, the stop mechanism 1210 of the first glide 1200 may be a stop mechanism such that sidewalls of the notch 1700 contact the stop mechanism 1210 of the first glide 1200, which stops the portion 1500 of arm rest assembly from sliding past the stop mechanism 1210 of the first glide 1200, and out of the bracket. As noted above, the stop mechanism 1210 includes an inward stop **1210*a* and an outward stop 1210*b* for bidirectional adjustment of the portion 1500 within the notch 1700**.

In certain instances, the portion 1500 of arm rest assembly includes lead-ins 1702, 1704 that facilitate installation of the portion 1500 of arm rest assembly within the glides 1200, 1300 (not shown in FIG. 17). In addition, the portion 1500 of arm rest assembly may include stop-features 1706, 1708 that are configured to facilitate placement and stopping movement of the portion 1500 of arm rest assembly within the glides. The stop-features 1706, 1708 of the portion 1500 of arm rest assembly project inwardly and contact a surface of the glides 1200, 1300 to assist the stop mechanism 1210 of the first glide 1200 as shown in further detail with reference to FIG. 18.

Figure 18:
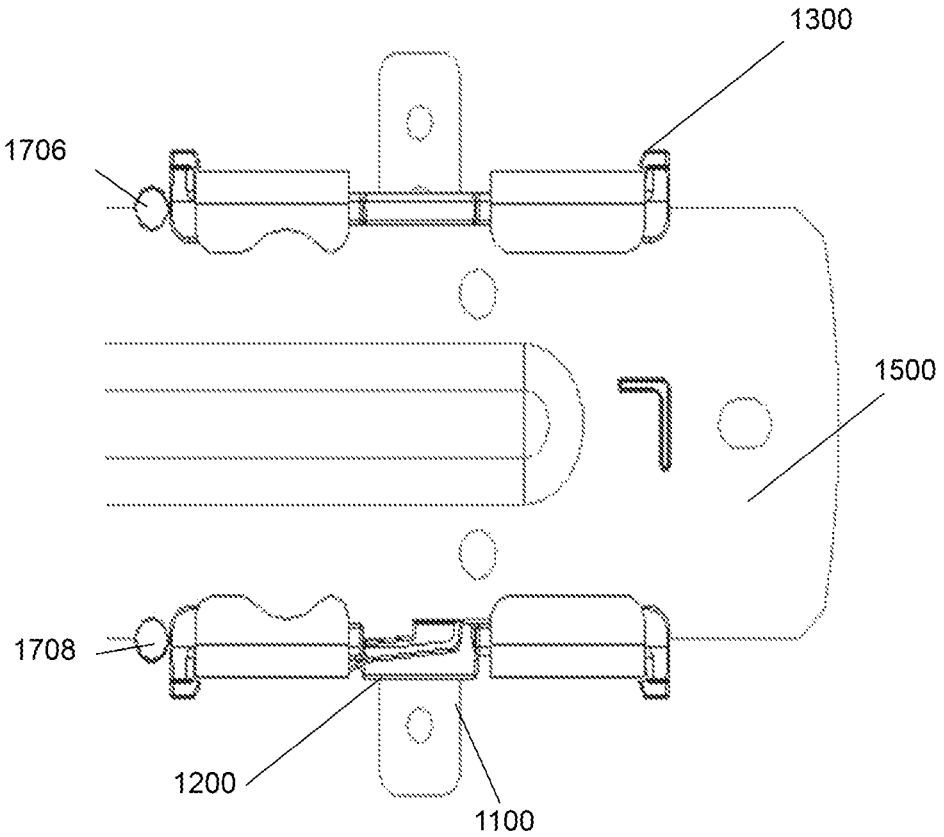
FIG. 18 shows a top view of an example bracket with a portion of arm rest assembly, and glides, consistent with various aspects of the present disclosure.

FIG. 18 shows a top view of an example bracket 100 with a portion 1500 of arm rest assembly, and glides 1200, 1300, consistent with various aspects of the present disclosure. The bracket 1100 may be coupled to a lower portion of a chair seat (e.g., as shown in FIGS. 1-2). In addition, the bracket 1100 may be configured to releasably couple the arm rest assembly to the chair seat and facilitate adjusting a width for the arm rest assembly relative to the chair seat. The bracket 1100 may also be configured to releasably couple the portion 1500 of arm rest assembly to the chair seat and facilitate adjusting a width for the arm rest assembly relative to the chair seat. The portion 1500 of arm rest assembly may be configured to slide within the first glide 1200 and the second glide 1300 (within the bracket 1100) for the user to releasably couple the arm rest assembly to the chair seat, and adjust the width for the arm rest assembly relative to the chair seat.

In addition, the portions of a chair may be separately packed together for assembly by a user (e.g., as noted above with respect to FIG. 1). The user may receive the portions of the chair after purchasing a package containing the chair. In certain instances, the bracket 1100, the first glide 1200, and/or the second glide 1300 may be separated from the arm rest assembly. The user may attach the first glide 1200 and the second glide 1300 to the bracket 1100 using the various orientation and alignment features discussed in further detail above.

FIG. 19 shows another example bracket assembly 1900, consistent with various aspects of the present disclosure. The bracket assembly 1900 may be coupled to a chair seat (e.g., as shown in FIGS. 1-2) and configured to releasably couple an arm rest assembly to the chair seat (e.g., as shown in FIG.

1). In addition, the bracket assembly 1900 may be configured to facilitate adjusting a width for the arm rest assembly relative to the chair seat.

The bracket assembly 1900 may be configured to mitigate against removal of an arm rest assembly from the bracket subsequent to releasably coupling the arm rest assembly thereto. For example, the bracket assembly 1900 may include a bracket 1100 and glides 1200, 1300 coupled thereto. The glides 1200, 1300 may be configured to stop the arm rest assembly from removal from the bracket 1100 subsequent to releasably coupling the arm rest assembly thereto.

The bracket assembly 900 may also include a lever 1902 coupled to the bracket 1100 and configured to immobilize the arm rest assembly within the bracket. The lever 1902 may be configured to actuate between a locked position (as shown in FIG. 19) and an unlocked position. In certain instances, the lever 1902 may be configured to push an orientation feature of the glide 1300 (as discussed in detail above) inward against the horizontal portion of the arm rest assembly in the locked position to immobilize the arm rest assembly within the bracket. The orientation feature may facilitate frictional engagement between the horizontal portion of the arm rest assembly and the lever 1902. The lever 1902 is arranged, relative to the bracket 1100, to move clear of the chair seat and aspects of the chair seat (e.g., upholstery). Similarly, the lever 1902 is arranged at a height, relative to the bracket 1100, to provide a direct force against an orientation feature 1302 of the second glide 1300 and portion of the arm rest assembly (not shown).

The illustrative implantable the bracket 1100 and glides 1200, 1300 shown in FIGS. 11-19 are not intended to suggest any limitation as to the scope of use or functionality of embodiments of the disclosure disclosed throughout this document. Neither should the illustrative bracket 1100 and glides 1200, 1300 be interpreted as having any dependency or requirement related to any single component or combination of components illustrated therein. Additionally, any one or more of the components depicted in FIGS. 11-19 can be, in embodiments, integrated with various ones of the other components depicted therein (and/or components not illustrated) such as those shown in FIG. 1-10. For example, the glides discussed with reference to FIG. 1-10 may include an additional feature 1306 that interfaces with a portion of a bracket (features 1108, 1110 shown in FIG. 11) and/or orientation features 1208, 1302.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A chair comprising:

a chair seat having an upper portion and a lower portion;

a seating portion secured to the upper portion of the chair seat;

a back support portion coupled to the chair seat and configured to support a back of the user;

an arm rest assembly releasably coupled to the chair seat including a horizontal portion having one or more notches;

a bracket coupled to the lower portion of the chair seat and configured to releasably couple the arm rest assembly to the chair seat and facilitate adjusting a width for the arm rest assembly relative to the chair seat; and one or more glides arranged within the bracket and configured as a pathway, raised relative to a lower surface of the bracket, for the horizontal portion of the arm rest assembly to slide to adjust the width of the arm rest assembly relative to the chair seat, the one or more glides including a snap-feature having a tab that projects inwardly from an exterior surface of the one or more glides configured to interface with the one of the notches.

2. The chair of claim 1, wherein the horizontal portion of the arm rest assembly is configured to: slide within the bracket for the user to releasably couple the arm rest assembly to the chair seat, and adjust the width for the arm rest assembly relative to the chair seat.

3. The chair of claim 2, wherein the one or more glides are configured to grip and at least partially surround the horizontal portion of the arm rest assembly to facilitate sliding thereof.

4. The chair of claim 3, wherein the one or more glides are configured to stop the arm rest assembly from removal from the bracket subsequent to releasably coupling the arm rest assembly thereto.

5. The chair of claim 4, wherein the one or more notches are configured to stop the arm rest assembly from removal from the bracket subsequent to releasably coupling the arm rest assembly thereto.

6. The chair of claim 5, wherein the one or more notches are configured to unsnap from the portion of the one or more glides in response to intervention of the user.

7. The chair of claim 1, further comprising a lever coupled to the bracket and configured to immobilize the arm rest assembly within the bracket.

8. The chair of claim 7, wherein the lever is configured to actuate between a locked position and an unlocked position.

9. The chair of claim 8, wherein the lever is configured to push the one or more glides inward against the horizontal portion of the arm rest assembly in the locked position to immobilize the arm rest assembly within the bracket.

* * * * *